US006612345B1

(12) United States Patent
Hosoda et al.

(10) Patent No.: US 6,612,345 B1
(45) Date of Patent: Sep. 2, 2003

(54) CARTRIDGE PAINT-CHARGING METHOD AND DEVICE THEREFOR

(75) Inventors: Toshio Hosoda, Fujieda (JP); Tomoaki Takeda, Tokyo (JP); Shinji Tani, Aichi (JP); Kimio Toda, Nagoya (JP); Takanobu Mori, Toyota (JP); Isamu Yamazaki, Toyota (JP)

(73) Assignee: ABB K.K., Tokyo (JP)

( * ) Notice: Subject to any disclaimer, the term of this patent is extended or adjusted under 35 U.S.C. 154(b) by 0 days.

(21) Appl. No.: 09/720,244

(22) PCT Filed: Apr. 25, 2000

(86) PCT No.: PCT/JP00/02704

§ 371 (c)(1),
(2), (4) Date: Jan. 4, 2001

(87) PCT Pub. No.: WO00/67913

PCT Pub. Date: Nov. 16, 2000

(30) Foreign Application Priority Data

May 6, 1999 (JP) ..... 11-126466

(51) Int. Cl.[7] ..... B05B 12/14; B05C 11/00; B05D 3/00

(52) U.S. Cl. ..... 141/20.5; 141/2; 141/9; 141/25; 141/18; 141/100; 141/285; 141/346

(58) Field of Search ..... 141/2, 9, 18, 20.5, 141/21, 25–27, 100, 285, 346

(56) References Cited

U.S. PATENT DOCUMENTS 5,293,911 A * 3/1994 Akeel ..... 141/346
5,759,277 A * 6/1998 Milovich et al. ..... 118/629
6,253,800 B1 * 7/2001 Yoshida et al. ..... 141/18

* cited by examiner

*Primary Examiner*—J. Casimer Jacyna
(74) *Attorney, Agent, or Firm*—Oblon, Spivak, McClelland, Maier & Neustadt, P.C.

(57) ABSTRACT

An apparatus for replenishing paint into a paint cartridge (25), which is capable of putting paint in respiratory circulation while the cartridge is in a waiting state. The apparatus includes a replenishing valve (61) which is capable of feeding paint to and from a paint chamber (30) of the paint cartridge (25) which is set on a replenishing stool (52), and a respiratory paint circulation valve (91) which is capable of feeding paint-extruding thinner to and from a thinner chamber (31) of the cartridge. After switching the replenishing valve (61) to a drain or discharge side, paint-extruding thinner is supplied from the respiratory paint circulation valve (91) to push paint out of the paint chamber (30) of the cartridge (25). Then, after switching the replenishing valve (61) to the side of a paint supply source, paint-extruding thinner is discharged by way of the respiratory paint circulation valve (91) to suck paint into the paint chamber (30). As a consequence, paint in the cartridge (25) is put in respiratory circulation to prevent separation and sedimentation of pigment components of the paint.

12 Claims, 16 Drawing Sheets

CARTRIDGE PAINT-CHARGING METHOD AND DEVICE THEREFOR

TECHNICAL FIELD

This invention relates to a method and an apparatus for replenishing paint into a cartridge, suitable for use, for example, in replenishing paint cartridges of different colors which are adapted to be replaceably mounted on a coating system in the course of a coating operation.

BACKGROUND ART

Generally, rotary atomizing head type coating systems are widely resorted to in coating vehicle bodies or the like. In this regard, recently, coating systems of this sort are required to meet demands for reductions of the amounts of paint and solvent which have be discarded at the time of color changes and for capability of handling a larger number of colors.

A rotary atomizing head type coating system, which is arranged to reduce the amounts of discarding paint and solvent and to cope with an increased number of paint colors, has been known, for example, from Japanese Laid-Open Patent Publication No. H8-229446. The rotary atomizing head type coating system which is described in this Laid-Open Patent Publication employs paint cartridges which are filled with various paint colors and arranged to be replaceably mounted on the system in the course of a coating operation on vehicle body.

The just-mentioned prior art rotary atomizing head type coating system is constituted by a housing having a coating machine mount portion on the front side and a cartridge mount portion on the rear side thereof, and a coating machine being mounted on the coating machine mount portion of the housing and including an air motor with a rotational shaft and a rotary atomizing head located on the front side of the air motor and mounted on the rotational shaft of the air motor. Further, formed axially through the rotational shaft of the air motor on the coating machine is a feed tube passage hole which is opened at its fore end into the rotary atomizing head and at its rear end into the cartridge mount portion of the housing.

Further, the coating system is provided with a number of paint cartridges of different colors to be replaceably mounted on the cartridge mount portion of the housing. Each one of the paint cartridges is constituted by a container which is filled with paint, and a feed tube which is extended axially forward from a front end of the container. The container portion of the paint cartridge is adapted to be removably fitted in the cartridge mount portion of the housing, and the feed tube is inserted into the above-mentioned feed tube passage hole.

Further, by a movable partition wall, the container of each paint cartridge is divided into a paint chamber which is in communication with the above-mentioned feed tube, and an paint-extruding air chamber which is in communication with an extruding air supply passage which is provided on the side of the cartridge to supply extruding air to the paint-extruding air chamber. Furthermore, provided on the side of the housing are an extruding air passage to be brought into communication with the extruding air passage on the side of the cartridge. Therefore, as extruding air is supplied to the air chamber within the cartridge container through the extruding air passage on the side of the housing and the extruding air passage on the side of the paint cartridge, the movable partition wall is displaced in a forward direction, thereby pushing the paint in the paint chamber into the rotary atomizing head through the feed tube.

In the case of the rotary atomizing head type coating system which is arranged as described above, firstly a paint cartridge of a specific color is selected from a number of paint cartridges of various colors and mounted on the cartridge mount portion of the housing. Nextly, a certain amount of air is supplied to the extruding air chamber of the paint cartridge to spurt paint in the paint chamber of the cartridge toward the rotary atomizing head through the feed tube. As a result, the paint is sprayed toward an object to be coated from the rotary atomizing head.

At the time of changing the paint color, the paint cartridge on the coating machine is simply replaced by a fresh one. Namely, the paint color can be changed without wastefully discarding paint and solvent.

On the other hand, upon finishing a coating operation, the paint cartridge, which has been consumed by the coating operation, needs to be replenished after unloading same from the housing.

Therefore, a paint replenisher is used for refilling paint into the paint cartridge in the manner as follows. According to the above-mentioned prior art, a paint cartridge replenisher is constituted by a number of quick joints which are extended from paint circulating pipe systems which are allotted to the respective paint colors. When replenishing paint into the paint chamber of a cartridge by the use of this paint replenisher, a consumed paint cartridge is removed from the housing and returned to a stand. In the next place, a quick joint is connected to a paint refilling port which is provided on the cartridge separately from the above-mentioned feed tube, and paint is replenished into the paint cartridge.

That is to say, in the case of the paint cartridge replenisher according to the above-mentioned prior art, for the purpose of paint replenishment, a paint refilling port is provided on the side of the paint cartridge separately from the feed tube. This makes the construction of the paint cartridge more complicate and invites increases in production cost. In addition, there arises a problem that the paint cartridge has an increased number of points of possible paint leaks.

Further, as mentioned above, at the time of paint replenishment, a quick joint which is extended out from a paint circulating piping system is connected to the paint refilling port on the paint cartridge. Namely, due to the manual efforts which are required for connecting a quick joint to a paint refilling port on the side of a paint cartridge, the replenishment of paint cartridges has been objectionably time-consuming.

Furthermore, until next use, each used paint cartridge is put in a predetermined position at a waiting station, with the paint chamber of the cartridge container either in a replenished state or in a consumed state containing a certain amount of residual paint. Therefore, if the paint cartridge is left in the waiting state continuously, separation and sedimentation could occur to the pigment components of the paint in the cartridge. Especially in the case of pigments such as fragments of aluminum and mica, separation and sedimentation could occur within a short period of time.

As a consequence, non-uniform dispersal of pigments occur to the paint in the paint chamber of the cartridge, which may result in irregular color shadings as well as in degradations in quality of coated surfaces. In addition, separated sedimentary pigments may cause clogging and dysfunction of the feed tube or other paint passages.

DISCLOSURE OF THE INVENTION

In view of the above-discussed problems with the prior art, it is an object of the present invention to provide a method and an apparatus for replenishing paint into a paint cartridge, which can make paint cartridge construction simpler and permit to replenish paint cartridges in a facilitated manner.

It is another object of the present invention to provide a method and an apparatus for replenishing paint into a paint cartridge, which can prevent separation and sedimentation of pigments in paint to guarantee improved quality of coatings.

According to the present invention, for achieving the above-mentioned objectives, there is provided a method for replenishing paint into a paint cartridge which is divided into a paint chamber and an extruding liquid chamber by a movable partition wall, the method comprising the step of: putting paint in the paint chamber of the cartridge in respiratory circulation to and from a paint supply source by imparting repeated respiratory paint suck-in and push-out motions to the movable partition wall in case the paint cartridge is going to be retained in a waiting state for a long period of time until a next coating operation.

With the arrangements just described, in case a replenished paint cartridge is retained in a waiting state for a long period of time until a next coating operation, paint in a paint chamber of the cartridge is put in respiratory circulation to and from a paint supply source by repeated paint suck-in and push-out motions of a movable partition wall in the cartridge, thereby preventing separation and sedimentation of pigment components of the paint.

According to the present invention, there is also provided an apparatus for replenishing paint into a paint cartridge having a container and a feed tube extended axially forward form the container, the container being divided by a movable partition wall into a paint chamber in communication with the feed tube and an extruding liquid chamber to and from which an extruding liquid is charged and discharged, the apparatus comprising: a connector member adapted to connect a fore end portion of the feed tube to a paint supply source; and a respiratory paint circulation means connected to the extruding liquid chamber of the container, and adapted to arouse respiratory paint circulation between the paint chamber and the paint supply source by feeding the extruding liquid to and from the extruding liquid chamber, putting said movable partition wall in respiratory paint suck-in and push-out motions.

With the arrangements just described, upon finishing a coating operation, a fore end portion of a feed tube of a cartridge is connected to a paint supply source through the connector member in the replenishing stool, and an extruding liquid in an extruding liquid chamber of the cartridge discharged by the respiratory paint circulation means while sucking replenishing paint into a paint chamber of the cartridge from the paint supply source through the connector member and a fore distal end of the feed tube.

After replenishing paint in this manner and in case the replenished paint cartridge is to be retained in a waiting state for a long period of time until a next coating operation, an extruding liquid is fed to the extruding liquid chamber of the cartridge by the respiratory paint circulation means to push out paint in the paint chamber toward the paint supply source. Then, the extruding liquid in the extruding liquid chamber is discharged by the respiratory paint circulation means to suck paint into the paint chamber of the cartridge.

Accordingly, while in a waiting state, the respiratory paint circulation means can repeat a paint suck-in action of taking paint into the paint chamber of the cartridge from the paint supply source, alternately with a paint push-out action of pushing out paint in the paint chamber of the cartridge toward the paint supply source.

Further, according to the present invention, there is provided an apparatus for replenishing paint into a paint cartridge having a container and a feed tube extended axially forward form the container, the container being divided by a movable partition wall into a paint chamber in communication with the feed tube and an extruding liquid chamber to and from which an extruding liquid is charged and discharged, the apparatus comprising: a replenishing stool having a feed tube passage hole axially extended therethrough to receive the feed tube of the paint cartridge and having a container support portion formed on an upper open side thereof to support the container of the paint cartridge; a connector member provided within the replenishing stool at a deeper position than the feed tube passage hole and adapted to be connect a fore end portion of the feed tube to a paint passage leading to a paint supply source; a replenishing valve connected to the connector member through the paint passage to turn the paint passage into and out of communication; an extruding liquid feed passage provided in the replenishing stool and adapted to be connected to the extruding liquid chamber when the paint cartridge is set on the container support portion of the replenishing stool; and a respiratory paint circulation means connected to the extruding liquid feed passage, and adapted to arouse respiratory paint circulation between the paint chamber and the paint supply source by feeding the extruding liquid to and from the extruding liquid chamber while the paint passage is turned into communication through the replenishing valve, imparting respiratory paint suck-in and push-out motions to the movable partition wall.

With the arrangements just described, a paint cartridge is set on the container support portion which is formed on the replenishing stool of the paint replenisher, with a feed tube of the cartridge passed into the feed tube passage hole until its fore end is engaged with the connector member. In this state, an extruding liquid in an extruding liquid chamber of the cartridge is discharged by the respiratory paint circulation means to suck paint into a paint chamber of the cartridge.

In case the replenished paint cartridge is retained in a waiting state for a long period of time until a next coating operation, the extruding liquid is fed to the extruding liquid chamber of the cartridge by the respiratory paint circulation means to push out paint in the paint chamber toward the paint supply source. Then, the extruding liquid in the extruding liquid chamber of the cartridge is discharged by the respiratory paint circulation means to suck paint into the paint chamber of the cartridge.

Accordingly, while in a waiting state, paint is constantly circulated between the paint chamber of the cartridge and the paint supply source by respiratory actions of the respiratory paint feed circulation means.

The connector member according to the present invention is preferably axially movably provided within the replenishing stool and constantly urged toward the feed tube by a spring interposed between the connector member and the replenishing stool.

With the arrangements just described, as a paint cartridge is set on the replenishing stool, a fore end portion of the feed tube fitted into the connector member. At this time, the connector member is moved axially to a certain extent depending upon an axial position of the fore end portion of the feed tube. Besides, by the spring, the connector member is pushed against the feed tube and securely held in liquid-tight fitting engagement with the feed tube.

Further, according to the present invention, the replenishing valve is preferably constituted by a paint inlet port connected to the paint supply source, a paint outlet port for connecting the paint inlet port to the connector member, a wash liquid supply port for connecting the paint outlet port to a wash liquid supply source, a wash liquid discharge port for connecting the paint outlet port to a drain side, a paint feed valve for opening and closing the paint inlet port, a wash liquid supply valve for opening and closing the wash liquid supply port, and a wash liquid discharge valve for opening and closing the wash liquid discharge port.

With the arrangements just described, when the paint supply port is closed by the paint feed valve and the wash liquid supply port is opened into communication by the wash liquid supply valve, the connector member is connected to the wash liquid supply source through the wash liquid supply valve. Therefore, as the extruding liquid in the extruding liquid chamber of the cartridge is discharged by the respiratory paint circulation means, a wash liquid is sucked into the paint chamber of the cartridge from the wash liquid supply source.

On the other hand, when the wash liquid supply source is closed by the wash liquid supply valve and the wash liquid discharge port is opened into communication by the wash liquid discharge valve, the connector member is communicated with the drain side through the wash liquid discharge valve. Therefore, as the extruding liquid is fed to the extruding liquid chamber of the cartridge by the respiratory paint circulation means, washing liquid in the paint chamber of the cartridge is pushed out toward the washing liquid supply source.

The paint chamber and feed tube of the paint cartridge are washed clean as the wash liquid is repeatedly sucked and pushed out to and from the paint chamber in the manner as described above.

Further, according to the present invention, the respiratory paint circulation valve is preferably constituted by an extruding liquid supply port connected to the extruding liquid source, an extruding liquid discharge port connected to an extruding liquid reservoir tank, a respiratory extruding liquid port connected to the extruding liquid feed passage, and a directional control valve for connecting the respiratory extruding liquid port to the extruding liquid supply port or discharge port.

With the arrangements just described, at the time of replenishing paint into the paint chamber of a cartridge, the directional control valve is switched to communicate the extruding liquid feed passage with the extruding liquid discharge port. Whereupon, the extruding liquid chamber of the cartridge is connected to the extruding liquid reservoir tank. Therefore, as the extruding liquid is discharged from the extruding liquid chamber of the cartridge, paint is sucked into the paint chamber under the influence of the paint supply pressure of the paint supply source.

On the contrary, when the directional control valve is switched to communicate the extruding liquid feed passage with the extruding liquid supply port, the extruding liquid chamber of the cartridge is connected to the extruding liquid supply source. Therefore, in this case the extruding liquid is supplied to the extruding liquid chamber of the cartridge, thereby pushing out paint in the paint chamber of the cartridge toward the paint supply source.

Further, preferably the above-mentioned connector member is provided with a feed tube positioning means for guiding a fore end portion of the feed tube into position when engaged therewith.

With the arrangement just described, upon fitting a fore end portion of the feed tube into the connector member, the fore end of the feed tube is automatically oriented into a fixed position within the connector member by the feed tube positioning means.

Further, according to the present invention, the container support portion of the replenishing stool is provided with a container positioning portion adapted to guide the container of the cartridge into position by engagement with a front portion of the container.

With the arrangement just described, upon setting a paint cartridge on the container support portion of the replenishing stool, a front portion of the cartridge container is engaged with the containing position portion and thereby oriented into a fixed position on the container support portion.

Further, according to the present invention, the paint replenisher further comprises a vacuum space to be defined between the container support portion of the replenishing stool and the paint cartridge when the paint cartridge is set on the container support portion, an air suction passage provided in the replenishing stool and opened to the vacuum space, air in the vacuum space being sucked through the air suction passage to hold the paint cartridge fixedly on the container support portion by suction force.

With the arrangements just described, after fitting a container of a paint cartridge in the container support portion of the replenishing stool, air is sucked out through the air suction passage to evacuate the vacuum space which is defined between the container support portion and the cartridge container, so that the paint cartridge is retained fixedly in the container support portion of the replenishing stool by suction grip. On the other hand, at the time of removing the paint cartridge from the replenishing stool, air is supplied to the vacuum space to free the paint cartridge from the suction grip.

Further, according to the present invention, the paint replenisher further comprises a pilot air passage provided in the replenishing stool to supply pilot air to a paint valve provided on the side of the paint cartridge.

With the arrangement just described, pilot air is supplied through the pilot air passage at the time of replenishing paint into a paint cartridge to open the paint valve in the cartridge. Accordingly, paint can be replenished into the cartridge through the passage within the feed tube. Upon finishing a paint replenishing operation, the supply of pilot air is cut off to close the paint valve, thereby preventing paint leaks through the feed tube of the cartridge.

BEST MODE FOR CARRYING OUT THE INVENTION

Figure 1:
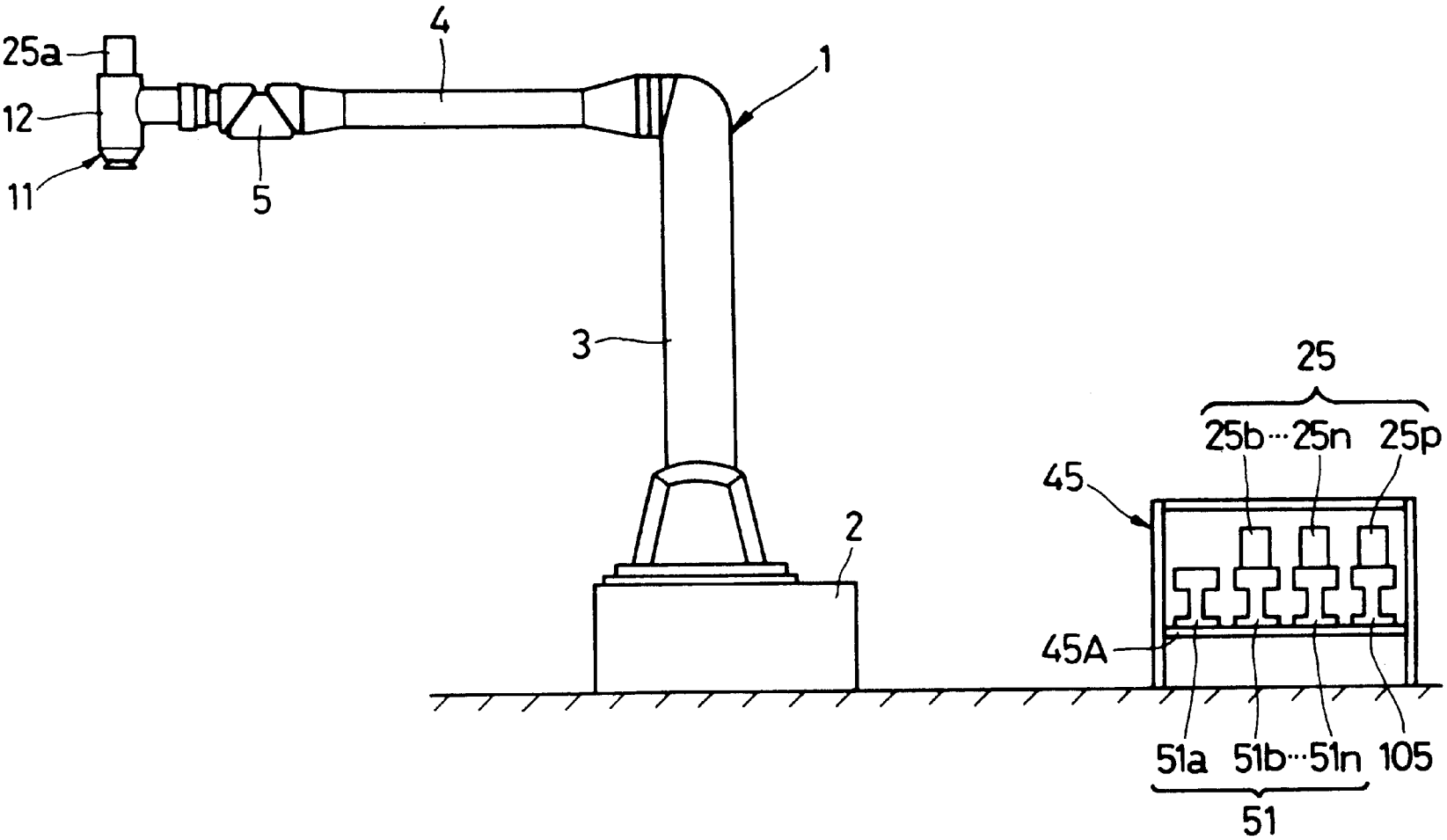
FIG. 1 is a front view of a paint replenisher according to the present invention, the paint cartridge replenisher being shown along with a rotary atomizing head type coating system and a coating robot.

Hereafter, the paint cartridge replenishing method and apparatus according to the present invention are described more particularly with reference to FIGS. 1 through 17, by way of a paint replenishing operation for a paint cartridge which is adapted to be replaceably mounted on a rotary atomizing head type coating system.

In the drawings, indicated at 1 is a coating robot serving as a working mechanism. The coating robot 1 is largely constituted by a base or pedestal 2, a vertical arm 3 which is rotatably and pivotally supported on the base 2, a horizontal arm 4 which is pivotally connected to a top end portion of the vertical arm 3, and a wrist portion 5 which is provided in a fore end portion of the horizontal arm 4.

Figure 2:
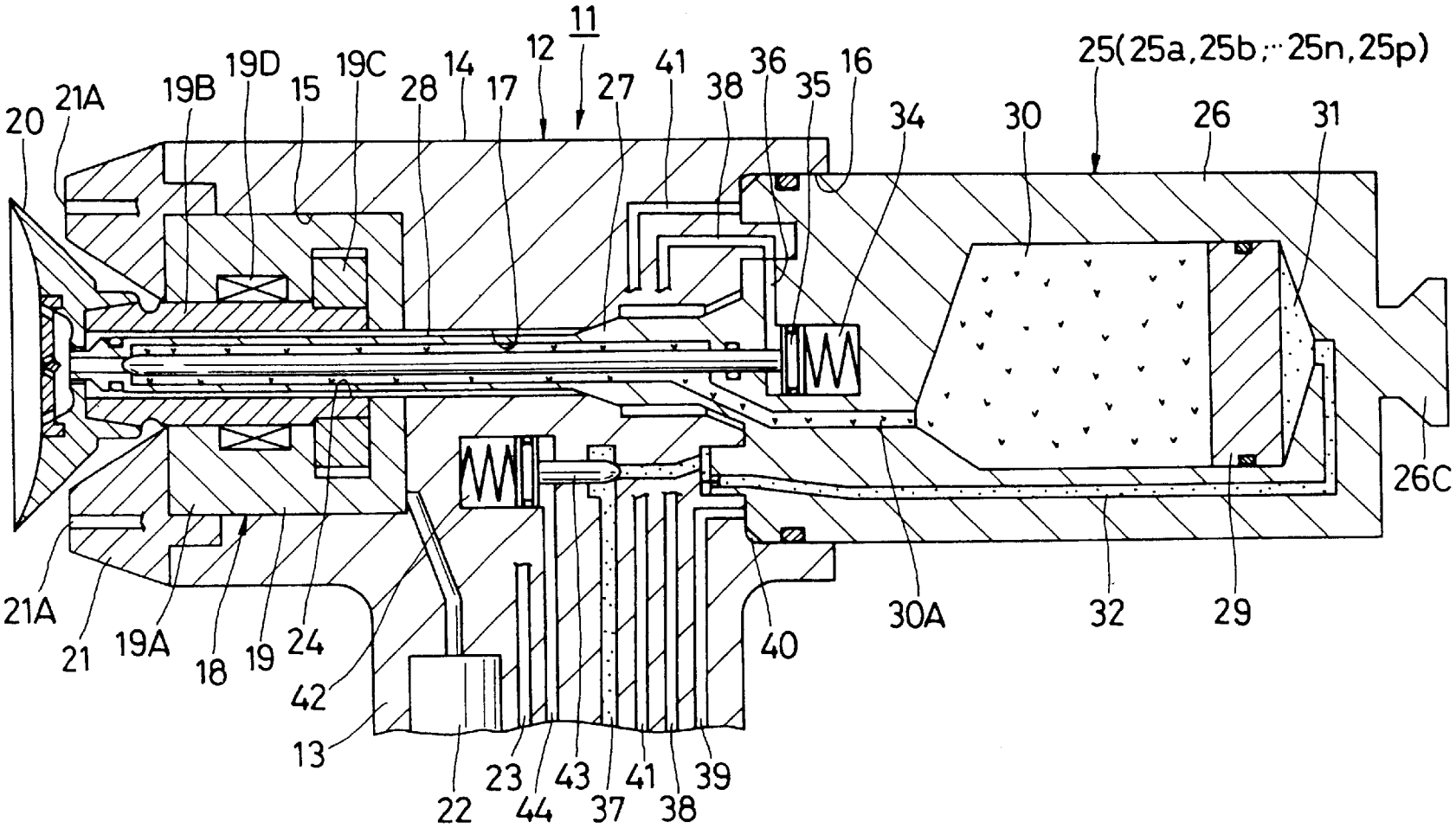
FIG. 2 is an enlarged sectional view of the rotary atomizing head type coating system shown in FIG. 1.

Indicated at 11 is a rotary atomizing head type coating system (hereinafter referred to simply as "coating system" for brevity) which is mounted on the coating robot 1. As shown in FIG. 2, the coating system 11 is largely constituted by a housing 12, feed tube passage holes 17 and 24, coating machine 18, paint cartridge 25, thinner valve 43 and so forth, as will be described hereinafter.

The housing 12 is formed, for example, of engineering plastics such as PTFE, PEEK, PEI, POM, PI, PET or the like, and mounted on the wrist portion 5 of the coating robot 1. The housing 12 is constituted by a neck portion 13 to be detachably connected to the fore end of the wrist portion 5, and a head portion 14 which is formed integrally at the fore end of the neck portion 13.

Figure 4:
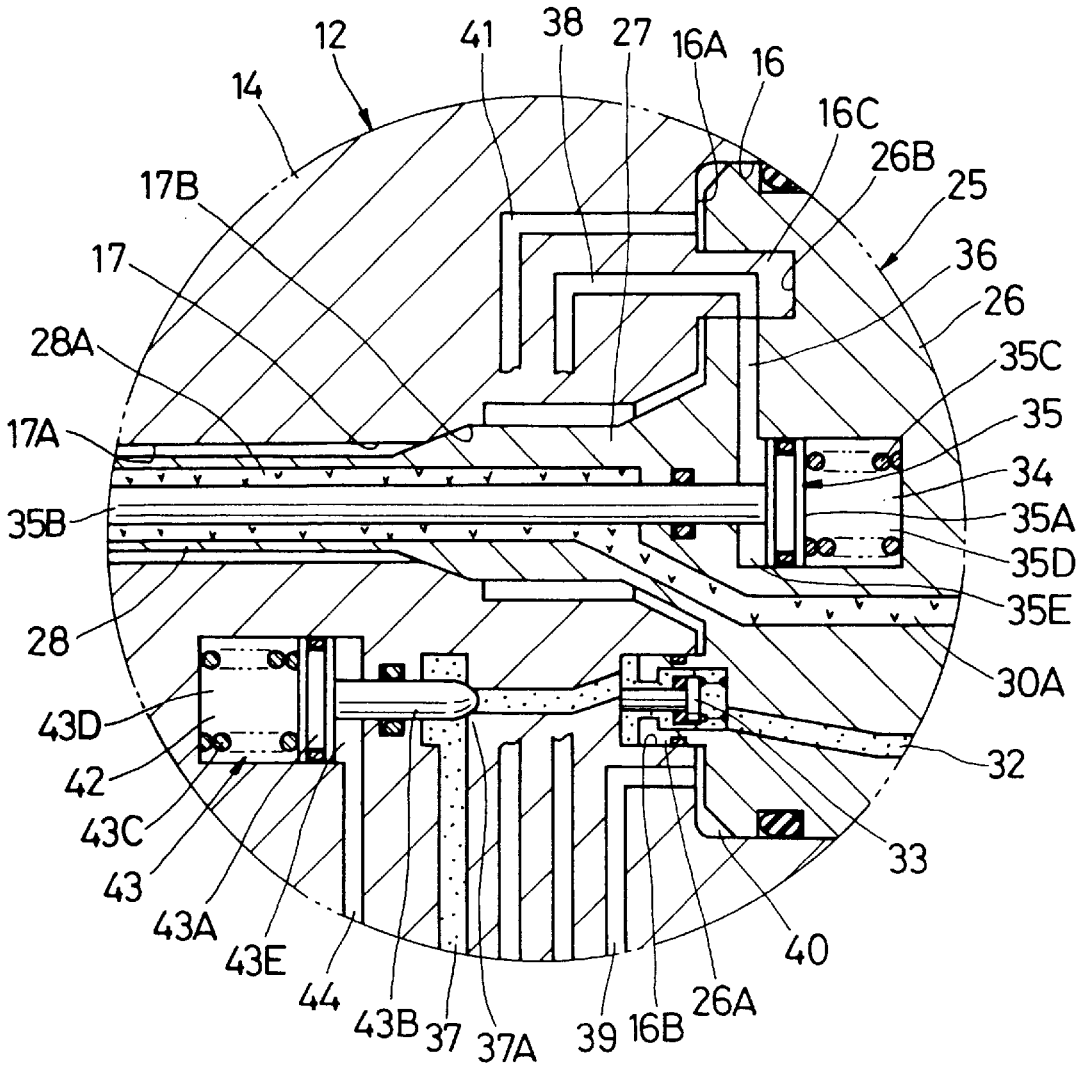
FIG. 4 is a fragmentary sectional view on an enlarge scale of paint valve, thinner valve and quick coupling shown in FIG. 1.

In this instance, formed on the front and rear sides of the head portion 14 are a coating machine mount portion 15 and a cartridge mount portion 16, each in the form of a cylindrical cavity. Further, as shown in FIG. 4, formed separately at a bottom portion 16A of the cartridge mount portion 16 are female and male coupling portions 16B and 16C for fitting engagement with male and female coupling portions 26A and 26B which are provided on the side of each container 26 as will be described hereinafter. The female and male coupling portions 16B and 16C on the cartridge mount portion 16 serve to orient the container 26 into position in the circumferential direction when setting the cartridge container 26 on the cartridge mount portion 16 of the housing.

Indicated at 17 is the feed tube passage hole on the side of the housing. The feed tube passage hole 17 is formed between and in communication with the coating machine mount portion 15 and the cartridge mount portion 16 on the head portion 14, including a front portion in the form of a feed tube passage portion 17A of a small diameter and a rear portion in the form of a forwardly converging conical portion 17B. In this instance, the feed tube passage portion 17A is formed in coaxial relation with a feed tube passage hole 24 which is provided on the side of the coating machine as will be described hereinafter. Further, the forwardly converging conical portion 17B is brought into fitting engagement with a conical projection 27 on the part of a paint cartridge 25, for the purpose of orienting the latter into position in both axial and radial directions.

Indicated at 18 is the coating machine which is set in the coating machine mount portion 15 on the head portion 14. As shown in FIG. 2, the coating machine 18 is largely constituted by an air motor 19 including a motor case 19A, rotational shaft 19B, air turbine 19C and air bearing 19D, a rotary atomizing head 20 adapted to be rotated by the air motor 19 to atomize supplied paint into finely divided particles under the influence of centrifugal force and to spray atomized paint toward a coating object, and a shaping air ring 21 located on the front side of the air motor 19. The shaping air ring 21 is provided with a large number of shaping air outlet holes 21A on its outer peripheral side. The shaping air outlet holes 21A are directed in a forward direction to spurt shaping air toward paint releasing edges of the rotary atomizing head 20, for shaping released paint particles into a desired spray pattern.

Indicated at 22 is a high voltage generator which is provided on the neck portion 13 of the housing 12. For example, the high voltage generator 22 is constituted by a Cockcroft circuit to elevate a source voltage, which is supplied from a power supply (not shown), to a high voltage of from −60 kv to −120 kv. The output side of the high voltage generator 22 is electrically connected, for example, to the air motor 19 to apply a high voltage to the rotary atomizing head 20 through the rotational shaft 19B of the air motor 19 for directly charging the paint on the rotary atomizing head 20.

Indicated at 23 are a plural number of air passages which are provided in the neck portion 13 of the housing 12 and which are connected to a control air source (not shown), including a turbine air passage for controlling the air motor 19, a bearing air passage, a brake air passage, a shaping air passage for shaping the spray pattern. In the particular embodiment shown, only one air passage is illustrated to represent the various air passages mentioned above.

Denoted at 24 is a feed tube passage hole which is provided on the side of the coating machine axially through the rotational shaft 19B of the air motor 19. The rear or base end of the feed tube passage hole 24 is opened into the feed tube passage portion 17A of the feed tube passage hole 17 on the side of the housing, while its fore end is opened into the rotary atomizing head 20. Further, the feed tube passage hole 24 on the side of the coating machine is formed in coaxial relation with the feed tube passage portion 17A of the feed tube passage hole 17 on the side of the housing. The feed tube 28 of the paint cartridge 25 is extractably inserted into these feed tube passage holes 17 and 24.

Figure 3:
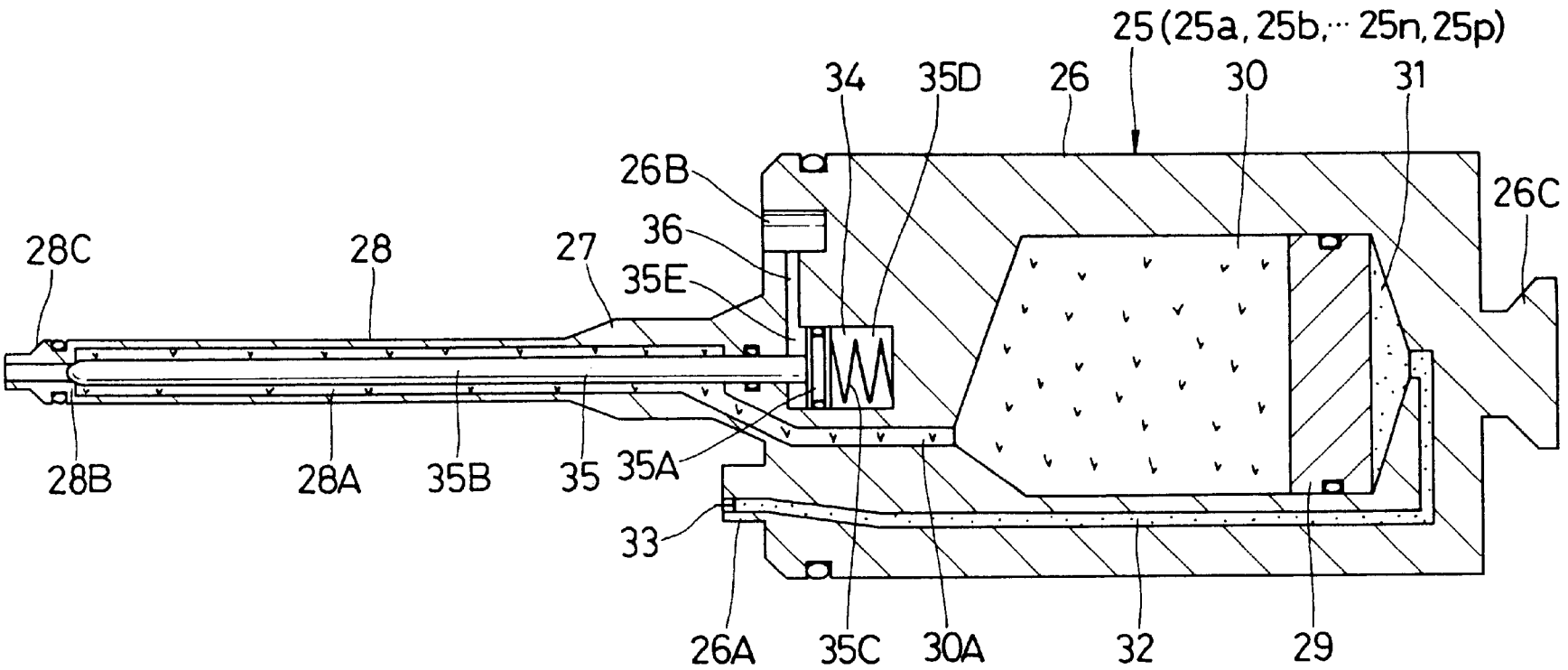
FIG. 3 is a longitudinal sectional view of a paint cartridge.

Indicated at 25*a*, 25*b*, . . . , 25*n* and 25*p* are paint cartridges (hereinafter collectively referred to as "paint cartridge or cartridge 25")) which contain paint colors of a, b, . . . , n and other paint color to be supplied to the rotary atomizing head 20. As shown in FIG. 3, each paint cartridge 25 is largely constituted by a container 26, a conical projection 27 which is provided at a front end of the container 26, a feed tube 28 which is projected axially forward from the conical projection 27, a piston 29 which is provided within the container 26 to serve as a movable partition wall, and a thinner passage 32 which is provided on the side of the paint cartridge to supply thinner as a paint-extruding liquid.

The paint colors a, b, . . . n are special colors which are used at a relatively high frequency and paint cartridges 25*a*, 25*b*, . . . 25*n* are provided exclusively and respectively for these colors. On the other hand, the paint colors r, s, . . . z are those colors which are used at a relatively low frequency, and a single paint cartridge 25*p* is commonly used by these colors.

The container 26, which constitutes a main body of the paint cartridge 25, is formed of engineering plastics similarly to the housing 12, and formed in a tubular (or cylindrical) shape and in an outside diameter which can be extractably fitted in the cartridge mount portion 16 of the housing. Provided on the front side of the container 26 are male and female coupling portions 26A and 26B in corresponding positions relative to the female and male coupling portions 16B and 16C on the side of the cartridge mount portion 16. Further, provided at the rear or tail end of the container 26 is a knob portion 26C to be gripped when replacing the paint cartridge 25.

In this instance, the male and female coupling portions 26A and 26B are provided to orient the container 26 into position in the radial direction when setting same on the cartridge mount portion 16 of the coating system 11. Further, the male and female coupling portions 26A and 26B also serve to orient the container 26 into position in the radial direction when mounting same on a container support portion 57 of a paint replenisher 51 which will be described hereinafter.

Indicated at 27 is a conical projection which is formed integrally on the front side of the container 26. As the container 26 of the paint cartridge 25 is set into the cartridge mount portion 16 of the coating system 11, the conical projection 27 is brought into fitting engagement with the forwardly converging conical portion 17B, thereby orienting the container 26 into position in axial and radial directions relative to the cartridge mount portion 11. Similarly, when the paint cartridge 25 is set on the container support portion 57 of the paint replenisher 51, the conical projection 27 is brought into fitting engagement with a converging conical portion 56A on the side of the container support portion 57, thereby orienting the container 26 into position in axial and radial directions relative to the container support portion 57.

Further, indicated at 28 is a feed tube which is extended from a fore end of the conical projection 27. An axially extending paint supply passage 28A is formed internally of the feed tube 28. The paint supply passage 28A has its base end connected to a paint chamber 30, which will be described hereinafter, and has its fore end opened into the rotary atomizing head 20. Further, the paint supply passage 28A is partly reduced in diameter to form a valve seat 28B on the inner periphery of a fore end portion of the feed tube 28, and a valve member 35B of a paint valve 35, which will be described hereinafter, is seated on and off the valve seat 28B. Further, a forwardly converging conical tapered surface 28C is formed around the outer periphery of a fore end portion of the feed tube 28. The conical tapered surface 28C is brought into fitting engagement with a conical cavity 59C in a connector member 59, which will be described hereinafter, for guiding the fore end of the feed tube 28 to a center position relative to the connector member 59. The feed tube 28 is formed in such a length that, when the paint cartridge 25 is set in the cartridge mount portion 16 of the housing 12, its fore end is extended into the rotary atomizing head 20.

In this instance, the feed tube 28 functions to receive the paint from the paint chamber 30 into the paint supply passage 28A and spurt it into the rotary atomizing head 20 through the fore end of the paint supply passage 28A. In addition, at the time of replenishing paint into the paint chamber 30, the fore end of the feed tube 28 is connected to the connector member 59 to serve as a replenishing or refilling port.

On the other hand, indicated at 29 is a piston which is axially slidably fitted in the container 26. By this piston 29, the container 26 is divided into the paint chamber 30, which is in communication with the paint supply passage 28A of the feed tube 28, and a thinner chamber 31 which contains thinner as a paint-extruding liquid.

Denoted at 32 is a thinner passage which is provided on the side of the paint cartridge. This thinner passage 32 is axially extended through the container 26 on the outer peripheral side thereof, with its one end opened in a fore end face of the male coupling portion 26A of the container 26 and the other end communicated with the thinner chamber 31. As thinner is supplied to the thinner chamber 31 through the thinner passage 32 on the side of the paint cartridge, the piston 29 is pushed forward toward the feed tube 28 to extrude the paint in the paint chamber 30 toward the rotary atomizing head 20 through the feed tube 28.

In this instance, in order to prevent leaks of the high voltage which is applied from the high voltage generator 22, the thinner to be used as an extruding liquid should be of an insulating type or of high electric resistance type. Further, in case thinner is used as an extruding liquid, it contributes to prevent paint from depositing and solidifying on inner wall surfaces of the container 26 as the piston 29 is displaced therealong, keeping the inner wall surfaces always in a wet state. Accordingly, it contributes to stabilize the frictional resistance between the piston 29 and the inner wall surfaces of the container 26, thereby ensuring smooth movements of the piston 29, in addition to improvements in tightness of the seal between the piston 29 and the inner wall surfaces of the container 26.

Figure 5:
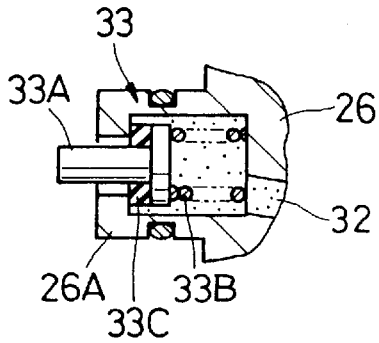
FIG. 5 is a fragmentary sectional view on an enlarged scale of the quick coupling of FIG. 4, the quick coupling being in a closed state.
Figure 6:
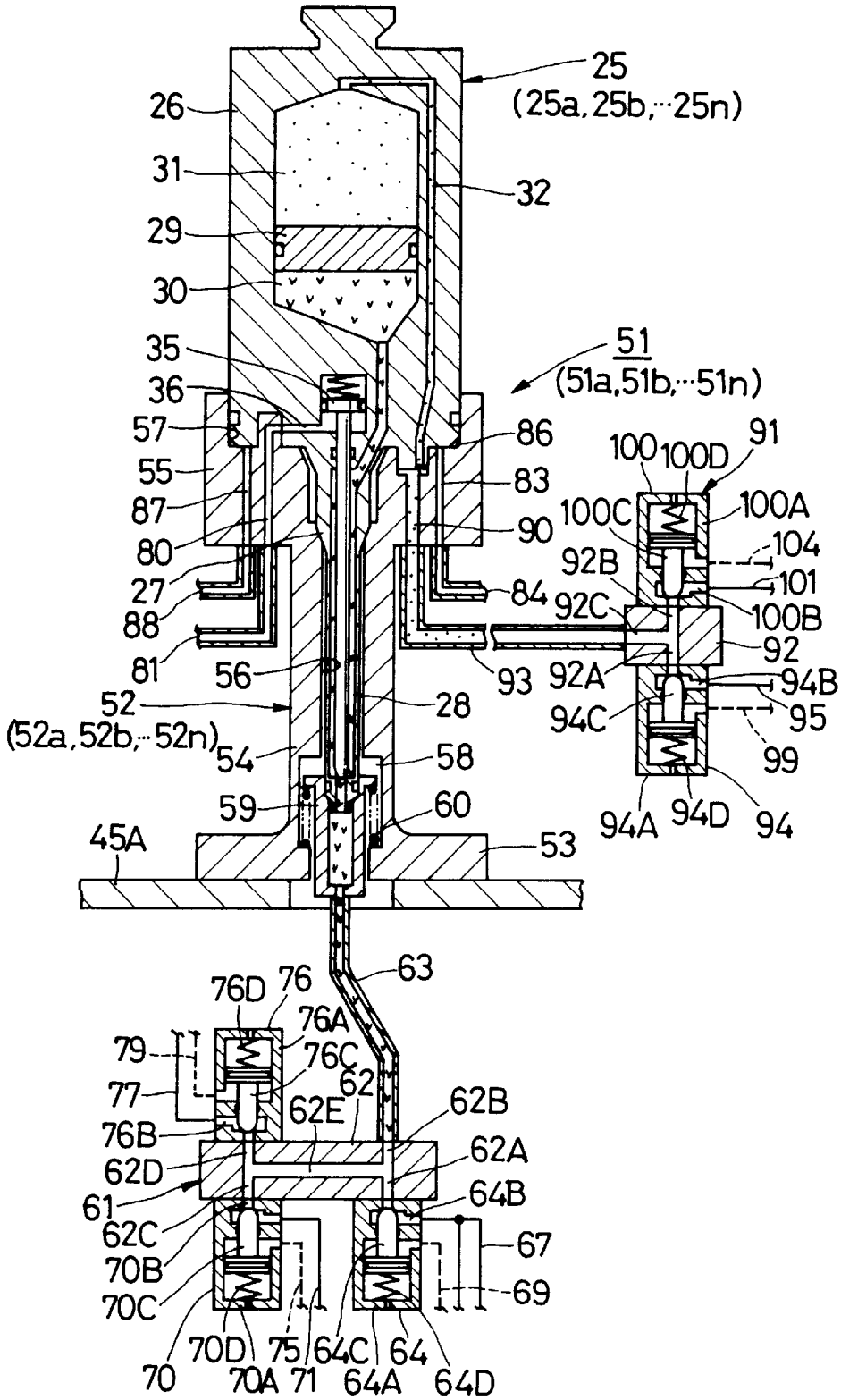
FIG. 6 is a vertical sectional view of the paint replenisher according to the present invention, the paint replenisher being shown along with a paint cartridge.

Indicated at 33 is a quick coupling which is provided at an open end of the thinner passage 32 on the side of the paint cartridge, which is provided in the male coupling portion 26A of the container 26. The quick coupling 33 is arranged as a check valve, including the afore-mentioned male coupling portion 26A of the container 26. As shown in FIG. 5, in addition to the male coupling portion 26A, the quick coupling 33 is largely constituted by a valve member 33A of a stepped cylindrical shape having a fore end portion thereof projected from the male coupling portion 26A, a coil spring 33B biasing the valve member 33A in the projecting direction, and a resilient ring 33C of rubber or other resilient material fitted on the outer periphery of the valve member 33A to seal a gap space between the valve member 33A and the male coupling portion 26A.

Further, when the paint cartridge 25 is set in the cartridge mount portion 16 with the male coupling portion 26A in engagement with the female coupling portion 16B as shown in FIG. 4, the projected fore end of the valve member 33A is abutted against a bottom portion of the female coupling portion 16B to open the quick coupling 33. As a result, the thinner passage 32 on the side of the paint cartridge is communicated with a thinner passage 37 which is provided on the side of the housing as will be described hereinlater, permitting inflow of thinner.

On the other hand, as the container 26 is removed from the cartridge mount portion 16, with the male coupling portion 26A disengaged from the female coupling portion 16B as shown in FIG. 5, the valve member 33A is pushed against the resilient ring 33C by the action of the coil spring 33B to close the thinner passage 32 on the side of the cartridge, thereby preventing outflow of thinner from the thinner passage 32. The quick coupling 33 is opened and closed through similar actions also at the time of setting the paint cartridge 25 on and off a container support portion 57 of a replenishing stool 52 which will be described hereinafter.

Indicated at 34 is a paint valve receptacle cavity portion which is provided in the container 26. This paint valve receptacle portion 34 is located on a center axis of the container 26 between the feed tube 28 and the paint chamber 30.

Denoted at 35 is a paint valve which is provided in the paint valve receptacle portion 34. The paint valve 35 is constituted by a piston 35A which is slidably fitted in the paint valve receptacle portion 34, an elongated valve member 35B which is connected at its base end to the piston 35A and extended at its fore end into the paint supply passage 28A in the feed tube 28 to seat on and off the valve seat portion 28B, and a valve spring 35C which is adapted to bias the valve member 35B toward the valve seat portion 28B through the piston 35A. Further, by the piston 35A, the paint valve receptacle portion 34 is divided into a spring chamber 35D and a pressure receiving chamber 35E which receive the valve spring 35C and pilot air, respectively. Thus, the paint valve 35 is arranged as an air-piloted directional control valve.

Normally, the valve member 35B of the paint valve 35 is seated on the valve seat portion 28B of the feed tube 28 under the influence of the biasing action of the valve spring 35C, thereby closing the paint supply passage 28A to suspend paint supply to the rotary atomizing head 20. On the other hand, when pilot air is supplied to the pressure receiving chamber 35E from a pilot air source through pilot air piping (both not shown) and via the pilot air passage 38 on the side of the housing and the pilot air passage 36 on the side of the cartridge, the valve member 35B is unseated from the valve seat portion 28B against the action of the valve spring 38C to permit paint supply from the paint chamber 30 to the rotary atomizing head 20. In this instance, one end of the pilot air passage 36 is opened in an inner peripheral surface of the female coupling portion 26B of the container 26, while the other end is communicated with the pressure receiving chamber 35E of the paint valve 35.

Denoted at 37 is the thinner passage which is formed on the side of the housing 12. This thinner passage 37 is axially extended in the neck portion 13 and bent rearward at a point alongside the female coupling portion 16B to present substantially an L-shape as a whole. Further, one end of the thinner passage 37 on the side of the housing is connected to a thinner feeder (not shown), while the other end is opened in a bottom portion of the female coupling portion 16B of the cartridge mount portion 16. The bent portion of the thinner passage 37 on the side of the housing is formed into a valve seat portion 37A for seating and unseating a valve member 43B of a thinner valve 43 which will be described hereinafter.

Indicated at 38 is the pilot air passage which is formed in the housing 12. One end of this pilot air passage 38 is connected to a pilot air source for the paint valve through pilot air piping (both not shown). The other end of the pilot air passage 38 is opened in an outer peripheral surface of the male coupling portion 16C, which is provided at a bottom portion 16A of the cartridge mount portion 16, correspondingly to the pilot air passage 36 on the side of the paint cartridge.

Indicated at 39 is an air suction passage which is provided in the housing 12 and opened in the bottom portion 16A of the cartridge mount portion 16. This air suction passage 39 is connected to a vacuum source through vacuum piping (both not shown). Through the air suction passage 39, air in a vacuum space 40 (FIG. 4), which is defined on the inner side of the container 26 of the cartridge 25 at the depth of the cartridge mount portion 16, is sucked out to hold the paint cartridge 25 firmly in the cartridge mount portion 16 by suction force.

Further, indicated at 41 is an ejection air passage which is provided in the housing and opened in the bottom portion 16A of the cartridge mount portion 16. This ejection air passage 41 is connected to an ejection air source through air piping (both not shown). At the time of dismantling the paint cartridge 25, air is supplied to the vacuum space 40 through the ejection air passage 41 to release the paint cartridge 25 from the suction grip.

Designated at 42 is a thinner valve receptacle cavity portion which is provided in the head portion 14 of the housing 12, and at 43 a thinner valve which is provided in the thinner valve receptacle portion 42. In this instance, similarly to the paint valve 35, the thinner valve 43 is constituted by a piston 43A which is slidably received in the thinner valve receptacle portion 42, a valve member 43B which is connected to the piston 43A at its base end and extended into the thinner passage 37 on the side of the housing at its fore end to be seated on and off the valve seat portion 37A, and a valve spring 43C which is adapted to bias the valve member 43B toward the valve seat portion 37A through the piston 43A. By the piston 43A, the thinner valve receptacle portion 42 is divided into a spring chamber 43D and a pressure receiving chamber 43E which receive the valve spring 43C and pilot air, respectively. Thus, the thinner valve 43 is arranged as an air-piloted directional control valve.

Normally, by the biasing force of the valve spring 43C, the valve member 43B of the thinner valve 43 is seated on the valve seat portion 37A of the thinner passage 37 on the side of the housing, thereby closing the thinner passage 37 to suspend thinner supply to the thinner chamber 31. On the other hand, when pilot air is supplied to the pressure receiving chamber 43E from a thinner valve pilot air source through pilot air piping (both not shown) and via the pilot air passage 44, the valve member 43B is unseated from the valve seat portion 37A against the action of the valve spring 43C to permit thinner supply to the thinner chamber 31. In this instance, one end of the pilot air passage 44 is connected to the thinner valve pilot air source through the pilot air piping, while the other end is communicated with the pressure receiving chamber 43E of the thinner valve 43.

On the other hand, indicated at 45 is a cartridge changer which is installed within a coating booth, at a position in the vicinity of the coating robot 1 (FIG. 1). In this instance, the cartridge changer 45 is largely constituted by a paint replenisher 51 or 105 which serves to replenish paint into a paint chamber 30 of a paint cartridge 25 which has been consumed as a result of a coating operation, in a manner as will be described in greater detail hereinafter, and a cartridge handler which is arranged to load or unload paint cartridges 25 between the cartridge mount portion 16 of the housing 12 and the paint replenisher 51 or 105. Further, provided in the vicinity of a cartridge loading and unloading position by the cartridge handler is a rotary atomizing head washer (not shown) to wash off deposited paint from the rotary atomizing head 20.

Now, the paint cartridge replenisher, which constitutes a part of the cartridge changer 45, is described below with reference to FIGS. 6 through 17.

Indicated at 51*a*' 51*b*, . . . 51*n* are paint cartridge replenishers which are provided on the cartridge changer 45 for paint colors a, b, . . . n (hereinafter referred to collectively as "paint replenisher" for brevity). The paint replenishers 51 are provided exclusively for paint colors a, b, . . . n which are used at a relatively high frequency, namely, exclusively for replenishing paint cartridges 25 of the colors a, b, . . . n. Each paint replenisher 51 is largely constituted by a replenishing stool 52, a feed tube passage hole 56 on the side of the replenishing stool, a connector member 59 and a replenishing valve 61.

Indicated at 52*a*, 52*b*, . . . 52*n* are replenishing stools of the paint replenishers 51*a*, 51*b*, . . . 51*n*, respectively (hereinafter referred to collectively as "replenishing stool 52" for brevity). Each one of the replenishing stools 52 is largely constituted by a foot portion 53 which is fixed on a transverse deck plate 45A of the cartridge changer 45 by bolts or other fixation means, a column portion 54 which rises vertically upward from the foot portion 53, and a seat portion 55 which is formed by spreading an upper end portion of the column portion 54. The replenishing stools 52 includes, in addition to the replenishing stools 52*a*, 52*b*, . . . 52*n* which are allotted to exclusive colors, a replenishing stool 52*p* of the paint replenisher 105 which is used for barely frequently used colors (see FIG. 14).

Denoted at 56 is a feed tube passage hole which is extended vertically through the column portion 54 of the replenishing stool 52 to receive the feed tube 28 of the paint cartridge 25. The feed tube passage hole 56 of the side of the replenishing stool is provided with a conically converging portion 56A at its upper end for guiding a container into position relative to the replenishing stool. More specifically, the conically converging portion 56A is coupled with the conical projection 27 which is provided on the front side of the container 26 to orient the container 26 into position in the axial and radial directions.

Indicated at 57 is a container support portion which is provided on one axial side (on the upper side) of the seat portion 55. The container support portion 57 which receives the container 26 of the paint cartridge 25 is in the form of a cylindrical cavity which is formed over the upper open end of the feed tube passage hole 56 of the side of the replenishing stool. As shown in FIGS. 8 to 12, formed separately on or in a bottom portion 57A of the container support portion 57 are a female coupling portion 57B to be coupled with the male coupling portion 26A of the container 26, a male coupling portion 57C to be coupling with the female coupling portion 26B of the container 26. These female and male coupling portions 57B and 57C serve to orient the container 26 into position in the radial direction when setting the container 26 on the container support portion 57.

Indicated at 58 is a connector receptacle hole which is formed at the other axial end of the replenishing stool 52, that is, at a deeper position than the feed tube passage hole 56 of the side of the replenishing stool. The connector receptacle hole 58 is cylindrical in shape and formed in such a way as to widen a deep end portion of the feed tube passage hole 56. A lower end of the connector receptacle hole 58 reduced in diameter through a stepped portion 58A and opened to the lower side of the replenishing stool.

Figure 7:
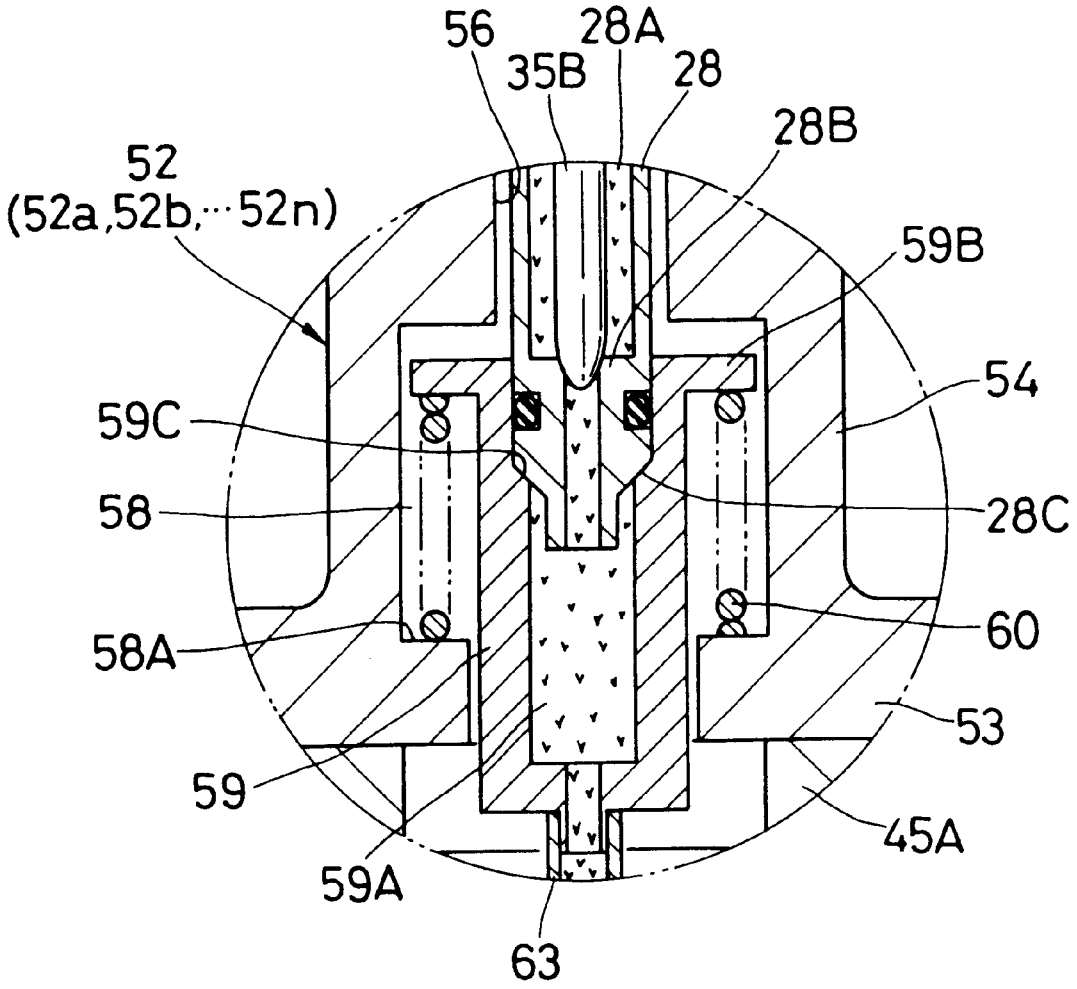
FIG. 7 is a vertical sectional view on an enlarged scale of connector member, coil spring and feed tube shown in FIG. 6.
Figure 8:
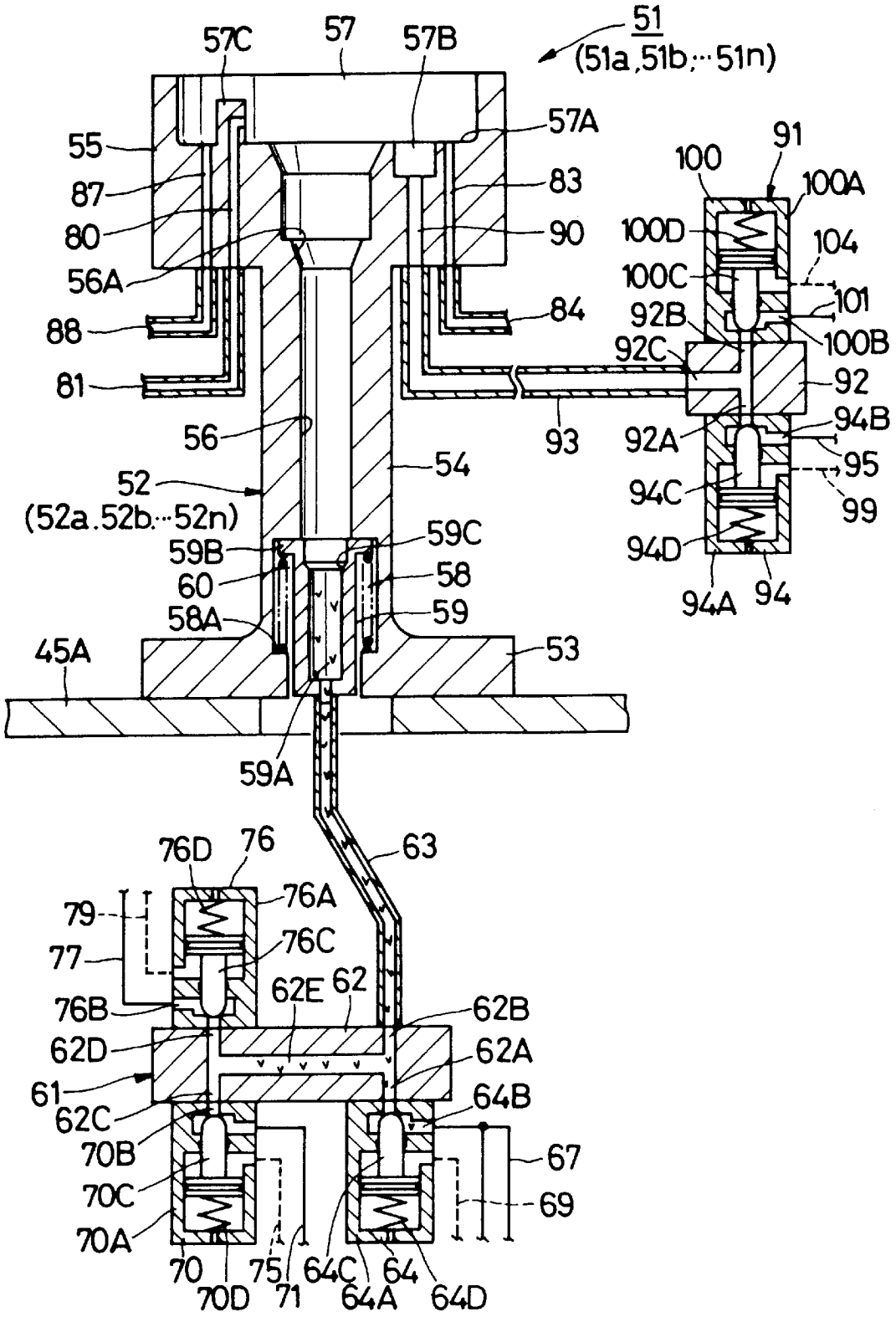
FIG. 8 is a vertical sectional view on an enlarged scale of a paint replenisher before setting a paint cartridge thereon.

Denoted at 59 is a connector member which is vertically slidably received in the connector receptacle hole 58. As shown in FIG. 7, the connector member 59 is formed in a hollow cylindrical shape, internally defining an axial paint passage 59A and a spring retainer portion 58B is provided on the upper end portion. Further, the connector member 59 is provided with a conically converging surface portion 59C in an upper end portion of the paint passage 59A to guide a feed tube into position. More particularly, the conically converging surface portion 59C is abutted against and engaged with the conical projection 28C of the feed tube 28 to guide the fore end of the latter into a center position in the paint passage 59A. Further, the paint passage 59A is connected to a replenishing valve 61 through a paint hose 63 which will be described after. Upon connecting the fore end of the feed tube 28 to the paint passage 59A of the connector member 59, the paint supply passage 28A of the feed tube 28 is connected to a paint circulating pipe 67 by the connector member 59 through the paint hose 63.

Indicated at 60 is a coil spring which is located around the outer periphery of connector member 59 and between a spring retainer portion 59B of the connector member 59 and the stepped portion 58A of the connector receptacle hole 58. Thus, by the coil spring 60, the connector member 59 is biased upward or toward the feed tube passage hole 56 of the replenishing stool.

In this manner, the connector member 59 is vertically movably received in the connector receptacle hole, and, by the coil spring 60, biased to oppose the feed tube 28. Therefore, even if the feed tube 28 is deviated to some extent from a right position in the vertical direction, such a positional deviation can be absorbed by an upward or downward movement of the connector member 59. In addition, the feed tube 28 can be securely fitted into the connector member 59 by the action of the coil spring 60.

Indicated at 61 is a replenishing valve which is communicated with the connector member 59 through a paint hose 63. The replenishing valve 61 functions to turn on and off paint supply to the paint cartridge 25 by opening and closing a paint passage in the paint hose 63 or other conduit means. Further, the replenishing valve 61 is provided for replenishing a frequently used exclusive color a, b . . . n as mentioned hereinbefore, and largely constituted by a manifold 62, a paint feed valve 64, a thinner supply valve 70 and a thinner discharge valve 76.

The manifold 62, which forms a valve casing for the replenishing valve 61, is constituted by a paint inlet port 62A, a paint outlet port 62B in communication with the paint inlet port 62A, a thinner supply port 62C in communication with the paint outlet port 62B, a thinner discharge port 62D in communication with the paint outlet port 62B, and an intercommunicating passage 62E which communicates the respective ports.

The paint hose 63 is provided between the replenishing valve 61 and the connector member 59 to form part of a paint supply passage, and formed of a flexible material. One end of the paint hose 63 is connected to the paint outlet port 62B of the manifold 62, while the other end is connected to the paint passage 59A of the connector member 59.

Figure 13:
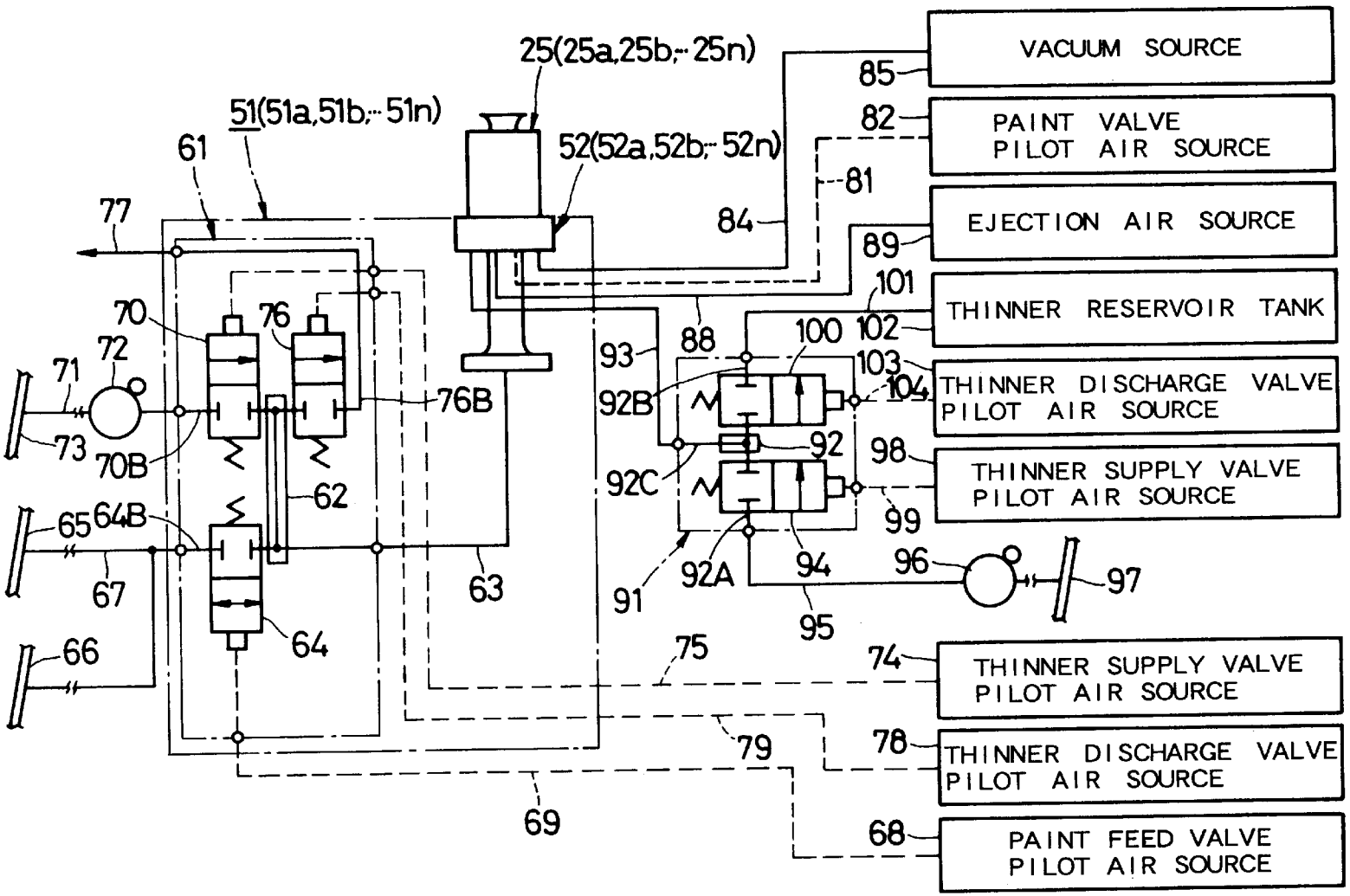
FIG. 13 is a circuit diagram of a paint replenisher to be used exclusively for a paint cartridge of a color which is used at a relatively high frequency.

The paint feed valve 64 is attached to the manifold 62 in such a way as to oppose the paint hose 63. This paint feed valve 64 is constituted by a valve casing 64A, a paint inlet port 64B which is provided in the valve casing 64A and connected to the paint inlet port 62A of the manifold 62, a valve member 64C which is slidably received in the valve casing 64A to open and close the paint inlet port 64B, and a valve spring 64D biasing the valve member 64C in a closing direction. Further, as shown in FIG. 13, the paint inlet port 64B is connected to a paint supply line 65 and a paint return line 66 through paint circulation piping 67. Furthermore, through pilot air piping 69, the paint feed valve 64 is connected to a paint feed valve pilot air source 68 for opening the valve member 64C against the action of the valve spring 64D.

Figure 10:
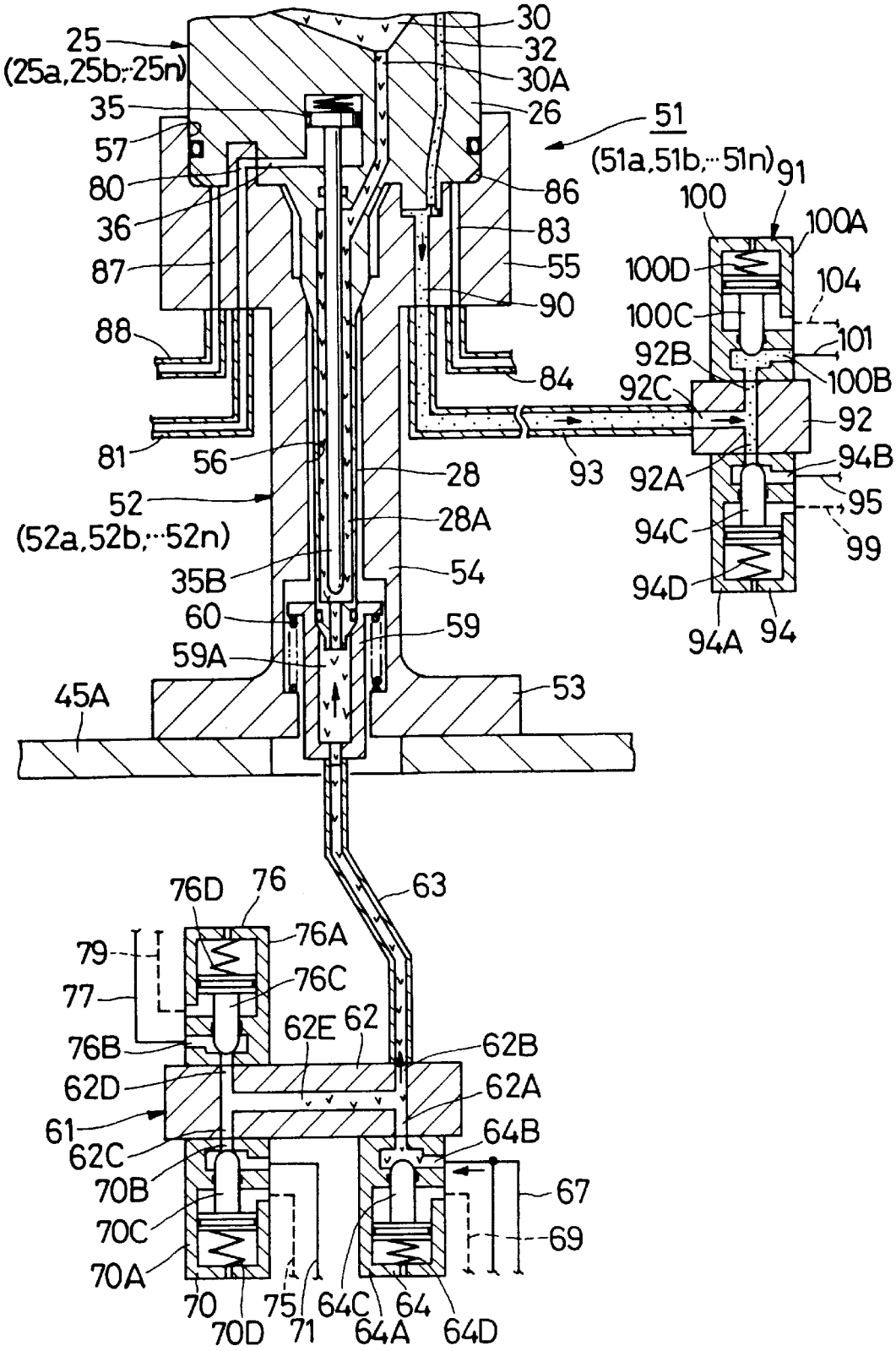
FIG. 10 is a vertical sectional view similar to FIG. 8, showing the paint replenisher in a stage of supplying paint into the paint cartridge.
Figure 11:
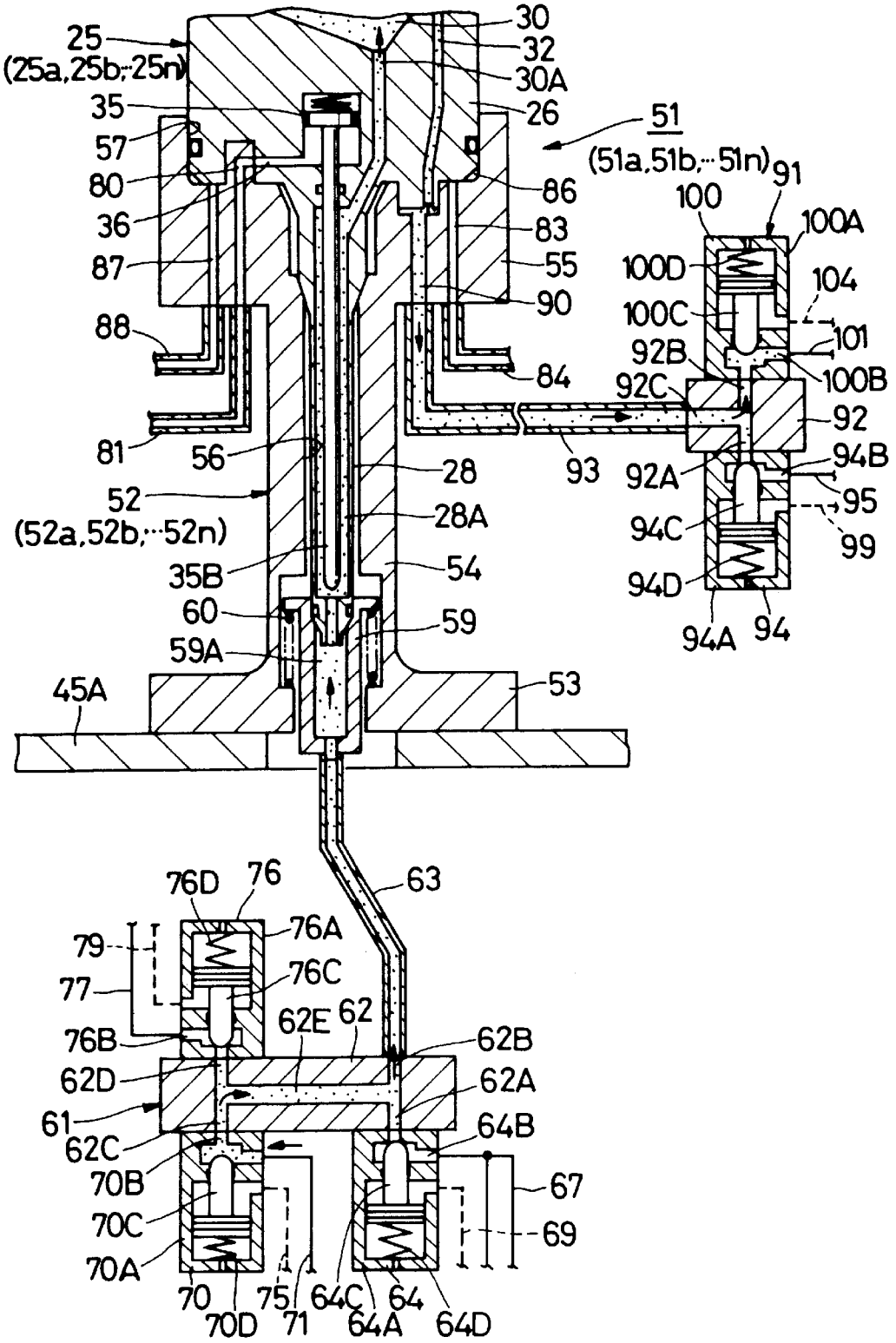
FIG. 11 is a vertical sectional view similar to FIG. 8, showing the paint replenisher in a stage of supplying thinner into the paint cartridge.
Figure 12:
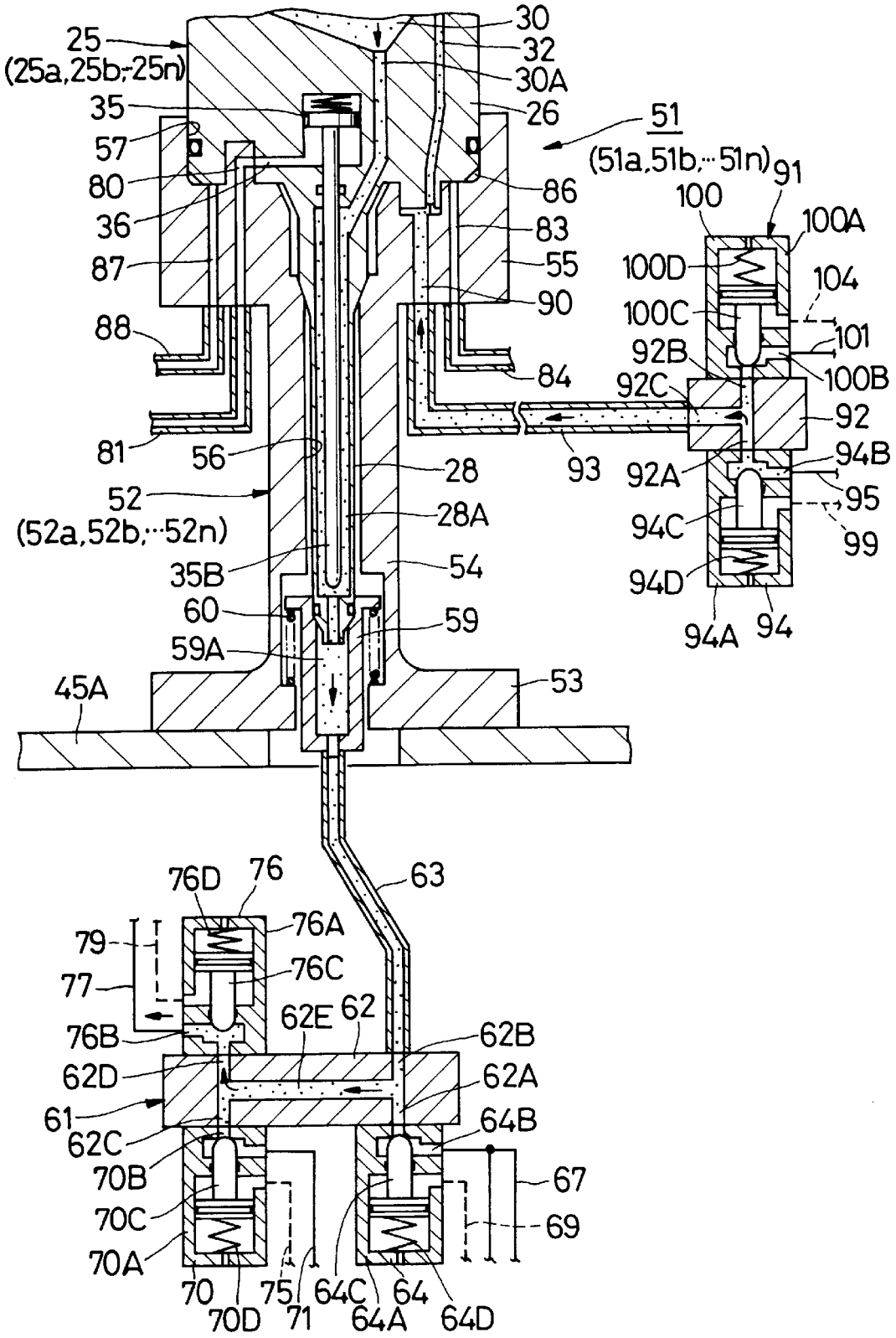
FIG. 12 is a vertical sectional view similar to FIG. 8, showing the paint replenisher in a stage of discharging thinner from the paint cartridge.

Normally, under the influence of the biasing action of the valve spring 64D, the paint inlet port 64B of the paint feed valve 64 is closed by the valve member 64C as shown in FIGS. 11 and 12. On the other hand, when pilot air is supplied from the paint feed valve pilot air source 68 through the pilot air piping 69, the valve member 64C of the paint feed valve 64 is displaced against the action of the valve spring 64D to the position shown in FIGS. 9 and 10. As a result, the paint inlet port 64B is uncovered to bring the paint hose 63 into communication with the paint circulation piping 67 through the paint inlet port 62A and paint outlet port 62B of the manifold 62, thereby permitting paint to flow into the paint hose 63.

In this instance, a paint supply source is constituted by the paint supply line 65 and paint return line 66 and paint circulation piping 67, along with a paint tank (not shown) from which paint is pumped into the paint supply line 65. On the contrary, paint is returned to the paint tank through the paint return line 66. The paint circulation piping 67 is connected to the paint supply line 65 and the paint return line 66 at its upstream and downstream ends, respectively. Therefore, paint is circulated between the paint tank and the paint chamber 30 of the paint cartridge 25 by respiratory actions of paint which will be described after.

Indicated at 70 is a thinner supply valve which is mounted on the manifold 62 to serve as a wash fluid supply valve. Similarly to the above-described paint feed valve 64, the thinner supply valve 70 is largely constituted by a valve casing 70A, a thinner supply port 70B which is provided in the valve casing 70A and connected to the thinner supply port 62C of the manifold 62, a valve member 70C which is slidably received in the valve casing 70A to open and close the thinner supply port 70B, and a valve spring 70D biasing the valve member 70C in a closing direction. As shown in FIG. 13, the thinner supply port 70B is connected to a thinner supply line 73, i.e., a wash fluid supply source, through thinner piping 71 and pressure regulator 72. Further, for opening the valve member 70C, the thinner supply valve 70 is connected to a thinner supply valve pilot air source 74 through pilot air piping 75.

Figure 9:
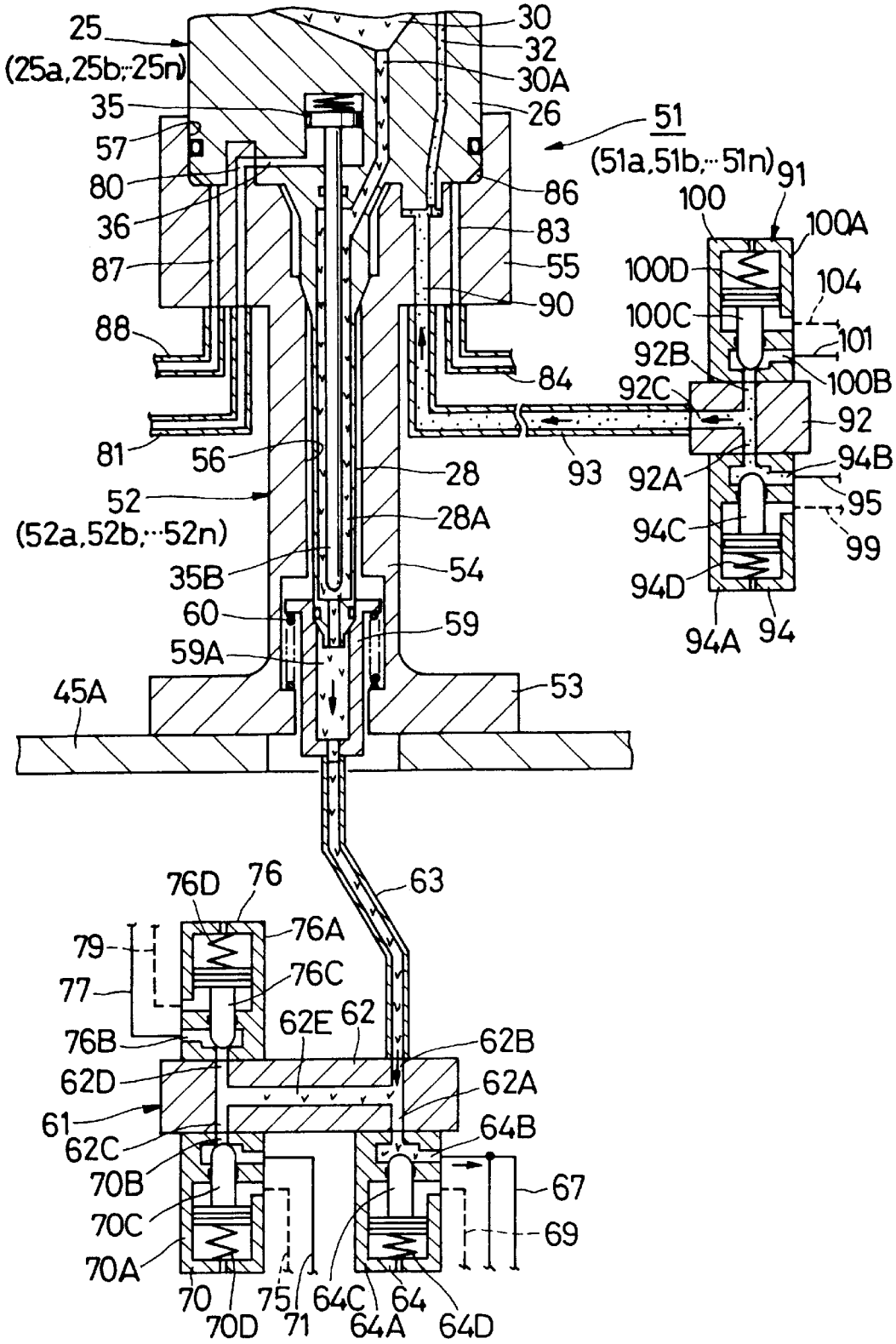
FIG. 9 is a vertical sectional view similar to FIG. 8, showing the same paint replenisher in a stage of discharging paint from a paint cartridge.

Normally, under the influence of the biasing action of the valve spring 70C, the thinner supply port 70B of the thinner supply valve 70 is closed by the valve member 70C as shown in FIGS. 9 and 10. On the contrary, when pilot air is supplied from the thinner supply valve pilot air source 74 through the pilot air piping 75, the valve member 70C of the thinner supply valve 70 is displaced against the action of the valve spring 70D as shown in FIG. 11, thereby opening the thinner supply port 70B to permit thinner supply to the paint hose 63 through the thinner supply port 62C, intercommunicating passage 62E and paint outlet port 62B of the manifold 62.

Indicated at 76 is the thinner discharge valve which is mounted on the manifold 62 in such a way as to oppose the thinner supply valve 70. Similarly to the above-described paint feed valve 64 and thinner supply valve 70, the thinner discharge valve 76 is largely constituted by a valve casing 76A, a thinner discharge port 76B which is provided in the valve casing 76A and connected to the thinner discharge port 62D of the manifold 62, a valve member 76C which is slidably received in the valve casing 76A to open and close the thinner discharge port 76B, and a valve spring 76D biasing the valve member 76C in a closing direction. Normally, under the influence of the biasing action of the valve spring 76D, the thinner discharge port 76B of the thinner discharge valve 76 is closed by the valve member 76C as shown in FIGS. 10 and 11. On the contrary, when pilot air supplied from a thinner discharge valve pilot air source 78 through pilot air piping 79, the valve member 76C is displaced to open the thinner discharge port 76B as shown in FIG. 12 , thereby permitting paint on the side of the paint cartridge 25 to be discharged to the side of drain piping 77 through the paint hose 63 and the paint outlet port 62B, intercommunicating passage 62E and thinner outlet port 62D of the manifold 62.

Further, when opened after replenishing paint into the paint chamber 30 of the cartridge 25, the thinner discharge valve 76 also functions as a residual pressure extraction valve by discharging paint in an amount which offsets residual pressures in the paint chamber 30 and the paint supply passage 28A of the feed tube 28 to restore the atmospheric pressure there.

Now, indicated at 80 is a pilot air passage which is provided on the side of the replenishing stool, more particularly, in the seat portion 55 of the replenishing stool. One end of this pilot air passage 80 is connected to a paint valve pilot air source 82 through pilot air piping 81, while the other end of the pilot air passage 80 is opened in a circumferential surface of the male connector portion 57C of the container support portion 57 at a position corresponding to the pilot air passage 36 on the side of the paint cartridge. Therefore, when the paint cartridge 25 is set on the container support portion 57 of the replenishing stool 52, the pilot air passage 80 is brought into communication with the pilot air passage 36 on the side of the paint cartridge to supply the paint valve 35 with pilot air from the paint valve pilot air source 82.

Indicated at 83 is an air suction passage which is provided in the seat portion 55 and opened at the bottom portion 57A of the container support portion 57. This air suction passage 83 is connected to a vacuum source 85 through vacuum piping 84. Through the air suction passage 83, air is sucked out of a vacuum space 86, which is defined in a deep portion of the container support portion 57 on the inner side of the container 26 of the cartridge 25, thereby holding the paint cartridge 25 fixedly on the container support portion 57 by suction force.

Further, denoted at 87 is an ejection air passage which is provided in the seat portion 55 and opened at the bottom portion 57A of the container support portion 57. This ejection air passage 87 is connected to an ejection air source 89 through air piping 88. At the time of removing the paint cartridge 25 from the replenishing stool 52, air is supplied to the vacuum space 86 through the ejection air passage 87 to cancel the suction grip on the paint cartridge 25.

On the other hand, indicated at 90 is a thinner feed passage which is provided in the seat portion 55 of the replenishing stool 52 as an extruding liquid feed passage and connectable with the thinner chamber 31 in the paint cartridge 25. One end of this thinner feed passage 90 is opened in the female coupling portion 57B of the container support portion 57, while the other end is connected to a respiratory paint circulation valve 91 as described below.

The respiratory paint circulation valve 91 is a respiratory paint circulation means which functions to suck paint into the paint chamber 30 of the paint cartridge 25 from the paint circulation piping 67 or to push paint in the paint chamber 30 of the paint cartridge 25 out into the paint circulation piping 67. The respiratory paint circulation valve 91 is largely constituted by a manifold 92, a thinner supply valve 94 and a thinner discharge valve 100.

The manifold 92 of the respiratory paint circulation valve 91 is provided with a thinner supply port 92A, a thinner discharge port 92B, and a respiratory thinner port 92C which is in communication with the thinner supply and discharge ports 92A and 92B. In this instance, through a paint hose 93, the respiratory thinner port 92C of the manifold 92 is connected with the thinner feed passage 90 which is provided in the replenishing stool 52.

Indicated at 94 is a thinner supply valve which is mounted on the manifold 92, and which is largely constituted by a valve casing 94A, a thinner supply port 94B which is provided in the valve casing 94A and connected with the thinner supply port 92A of the manifold 92, a valve member 94C which is slidably received in the valve casing 94A to open and close the thinner supply port 94B, and a valve spring 94D biasing the valve member 94C in a closing direction. In this instance, as shown in FIG. 13, through the thinner piping 95 and pressure regulator 96, the thinner supply port 94B is connected to a thinner supply line 97 which serves as an extruding liquid supply source. Further, through pilot air piping 99, the thinner supply valve 94 is connected to a thinner valve pilot air source 98 for displacing the valve member 94C to an open position against the biasing action of the valve spring 94D. The thinner supply pressure by the thinner supply line 97 is set at a higher pressure level than both paint supply pressure by the paint supply line 65 and thinner supply pressure by the thinner supply line 73.

Normally, under the influence of the biasing action of the valve spring 94D, the thinner supply port 94B is closed by the valve member 94C as shown in FIGS. 10 and 11. On the other hand, when pilot air is supplied from the thinner supply valve pilot air source 98 through pilot air piping 99, the valve member 94C is displaced against the action of the valve spring 94D to open the thinner supply port 94B, thereby communicating the thinner feed passage 90 with the thinner supply line 97 through the thinner supply port 92A and respiratory thinner port 92C of the manifold 92 and the thinner hose 93.

Indicated at 100 is a thinner discharge valve which is mounted on the manifold 92 in such a way as to oppose the thinner supply valve 94. Substantially in the same manner as the above-described thinner supply valve 94, the thinner discharge valve 100 is largely constituted by a valve casing 100A, a thinner discharge port 100B which is provided in the valve casing 100A and connected to the thinner discharge port 92B of the manifold 92, a valve member 100C which is slidably received in the valve casing 100A to open and close the thinner discharge port 100B, and a valve spring 100D biasing the valve member 100C in a closing direction. In this instance, through thinner piping 101, the thinner discharge port 100B is connected to a thinner reservoir tank 102 which is provided to serve as an extruding liquid reservoir tank. Further, through pilot air piing 104, the thinner discharge valve 100 is connected to a thinner valve pilot air source 103 for displacing the valve member 100C to an open position against the biasing action of the valve spring 100D.

Normally, the thinner discharge port 100B of the thinner discharge valve 100 is closed by the valve member 100C as shown in FIGS. 9 and 12. On the contrary, when pilot air is supplied from the thinner discharge valve pilot air source 103, the valve member 100C displaced to open the thinner discharge port 100B as shown in FIGS. 10 and 11, communicating the thinner feed passage 90 with the thinner reservoir tank 102 through the thinner hose 93, the respiratory thinner port 92C and thinner discharge port 92B of the manifold 92, thereby permitting thinner on the side of the paint cartridge 25 to return to the thinner reservoir tank 102.

With the respiratory paint circulation valve 91 being arranged as described above, the thinner supply valve 94 is closed and the thinner discharge valve 100 opened either when paint is supplied to the paint chamber 30 of the paint cartridge 25 from the paint circulation piping 67 or when thinner is supplied to the paint chamber 30 from the thinner supply line 73. Whereupon, the thinner feed passage 90 and thinner hose 93 are switched to the side of the thinner discharge port 100B and thinner piping 101 through the respiratory thinner port 92C of the manifold 92. As a result, the thinner chamber 31 of the paint cartridge 25 is put under the atomospheric pressure, permitting to suck paint into the paint chamber 30 through the paint circulation piping 67 and replenishing valve 61 or to suck thinner thereinto through the thinner supply line 73 and replenishing valve 61.

On the other hand, the thinner supply valve 94 is opened and the thinner discharge valve 100 is closed at the time of pushing out paint in the paint chamber 30 pushed into the paint circulation piping 67 or pushing out thinner in the paint chamber 30 to the drain side. Whereupon, the thinner feed passage 90 and thinner hose 93 are switched to the side of the thinner supply port 94B and thinner piping 95 through the respiratory thinner port 92C. As a result, thinner is supplied to the thinner chamber 31 of the paint cartridge 25 from the thinner supply line 97 which is at a higher pressure level as compared with the paint supply pressure of the paint supply line 65 and the thinner supply pressure of the thinner supply line 73. Accordingly, by the thinner which flows into the thinner chamber 31, paint in the paint chamber 30 can be pushed out into the paint circulation piping 67 through the replenishing valve 61, or thinner in the paint chamber 30 can be pushed out to the side of the drain pipe 77 through the replenishing valve 61.

Figure 14:
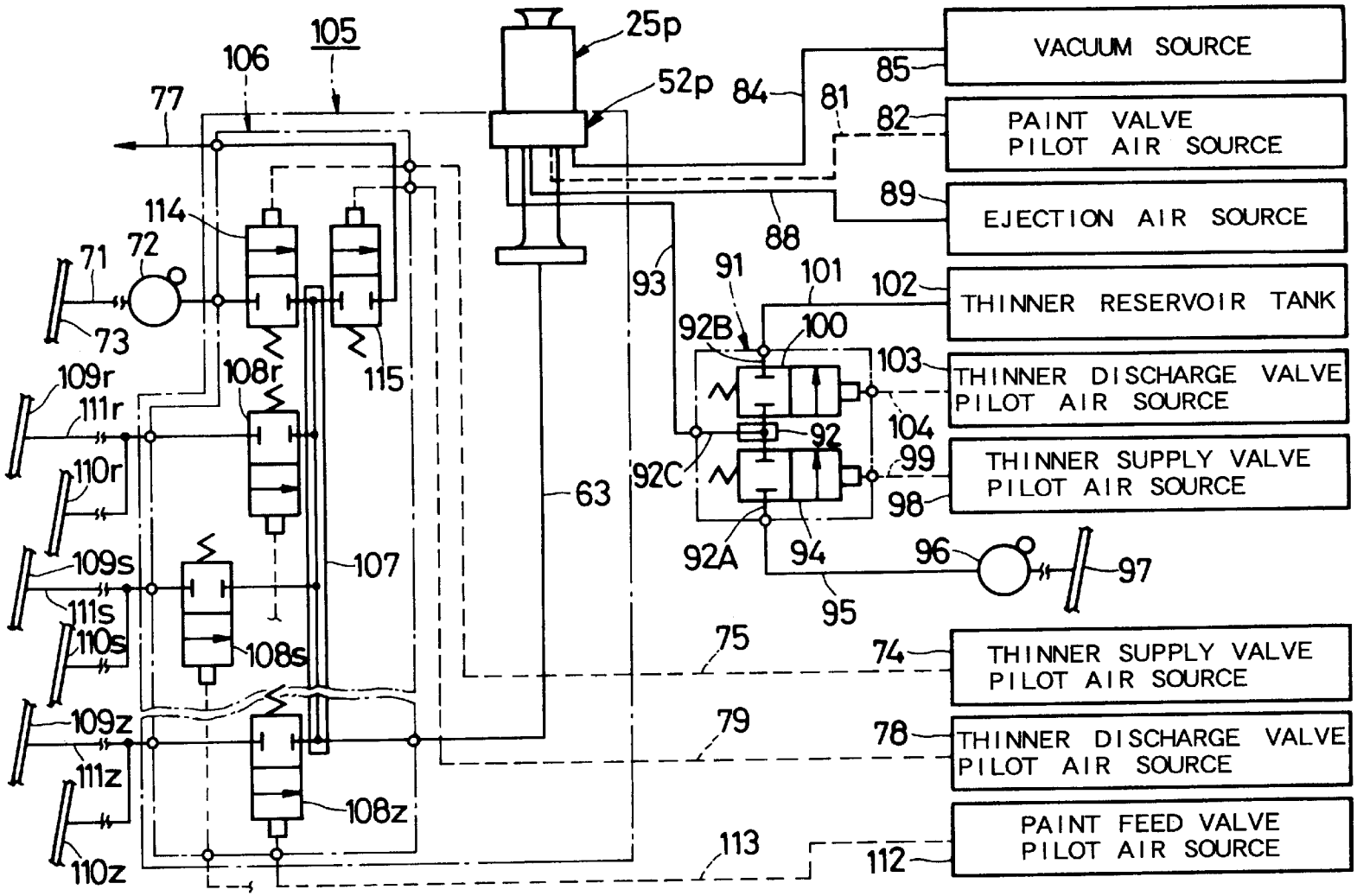
FIG. 14 is a circuit diagram of a paint cartridge replenisher to be used exclusively for a paint cartridge of a color which is used at a relatively low frequency.

On the other hand, indicated at 105 is another paint replenisher which is provided on the cartridge changer 45 as shown in FIG. 14. This paint replenisher 105 is provided for replenishing a paint cartridge 25*p* which is allotted to barely frequently used colors r, s, . . . z.

Indicated at 106 is a replenishing valve for the paint replenisher 105. This replenishing valve 106 is largely constituted by a manifold 107, paint feed valves 108*r*, 108*s*, . . . 108*z*, a thinner supply valve 114, and a thinner discharge valve 115, which will be described hereinafter.

On the manifold 107 of the replenishing valve 106, the above-described paint hose 63 is mounted, along with paint feed valves 108*r*, 108*s*, . . . 108*z*, thinner supply valve 114 and thinner discharge valve 115 which will also be described hereinafter.

The paint feed valves 108*r*, 108*s*, . . . 108*z* are mounted on the manifold 62 for feeding paint colors r, s, . . . z to and from the latter, respectively. The paint feed valve 108*r* is connected to a paint supply line 109*r* in which paint color r is circulated, as well as to a paint circulation line 111*r* which is connected to a paint return line 10*r*. The paint feed valve 108*s* is connected to a paint supply line 109*s* in which paint color s is circulated, as well as to a paint circulation line 111*s* which is connected to a paint return line 110*s*. The paint feed valve 108*z* is connected to a paint supply line 109*z* in which paint color z is circulated, as well as to a paint circulation line 111*z* which is connected to a paint return line 110*z*. Further, these paint feed valves 108*r*, 108*s*, . . . . . 108*z* are separately and independently connected to paint feed valve pilot air sources 112 (only one is shown in the drawings) through pilot air piping 113.

Indicated at 114 and 115 are the thinner supply valve and the thinner discharge valve which are assembled with the manifold 107.

By operation of the replenishing valve 106, the paint feed valves 108*r*, 108*s*, . . . 108*z* are opened and closed to select one particular color from a variety of paint colors r, s, . . . z and supply it to the common paint cartridge 25*p*. Further, at the time of color change, deposited residues of a previous color in the paint chamber 30 of the paint cartridge 25*p* and in the paint hose 63 are washed away by alternately opening and closing the thinner supply valve 114 and the thinner discharge valve 115.

Figure 15:
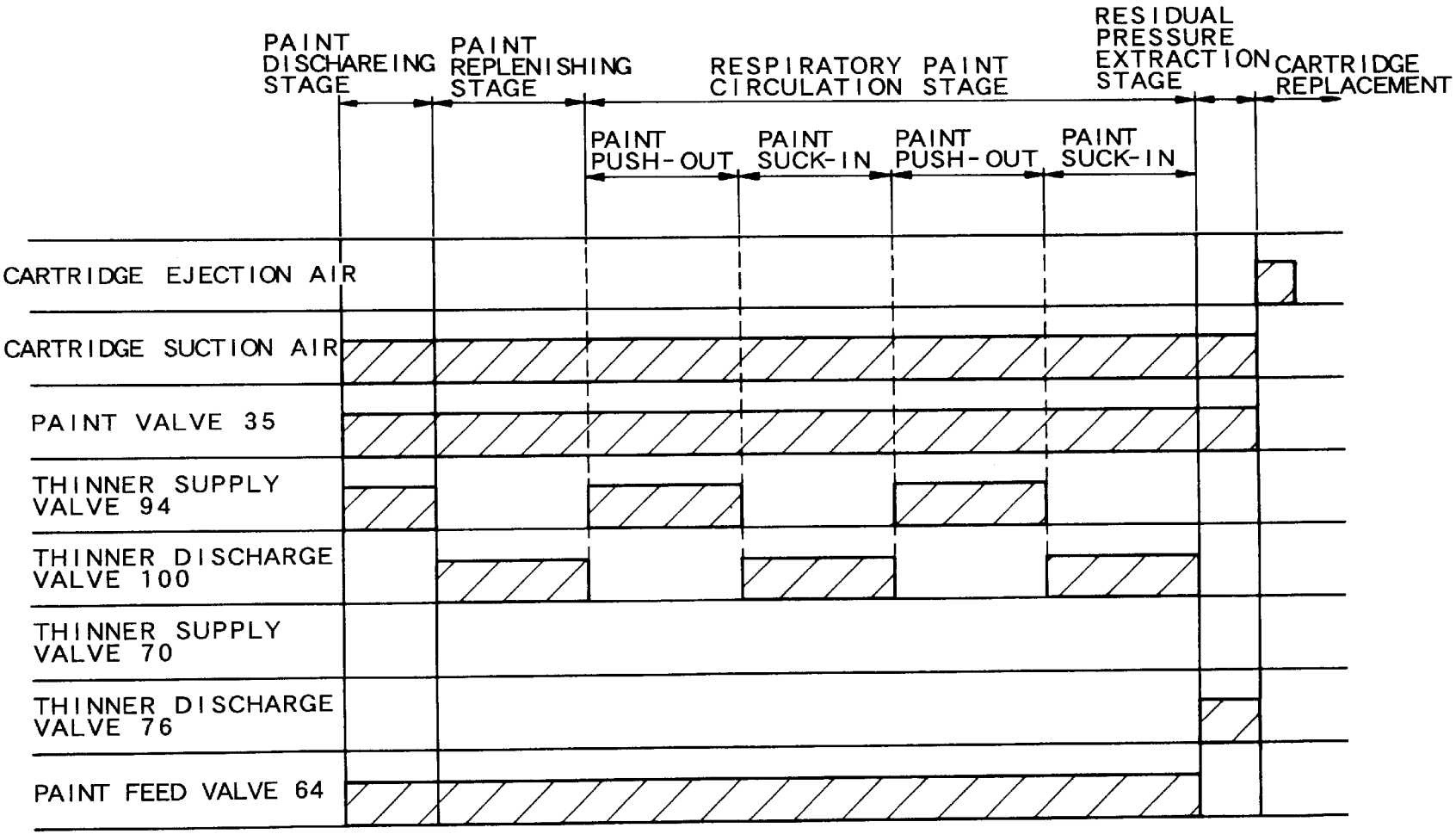
FIG. 15 is a time chart of a paint replenishing operation by the paint replenisher exclusively serving for a paint cartridge of a frequently used color.
Figure 16:
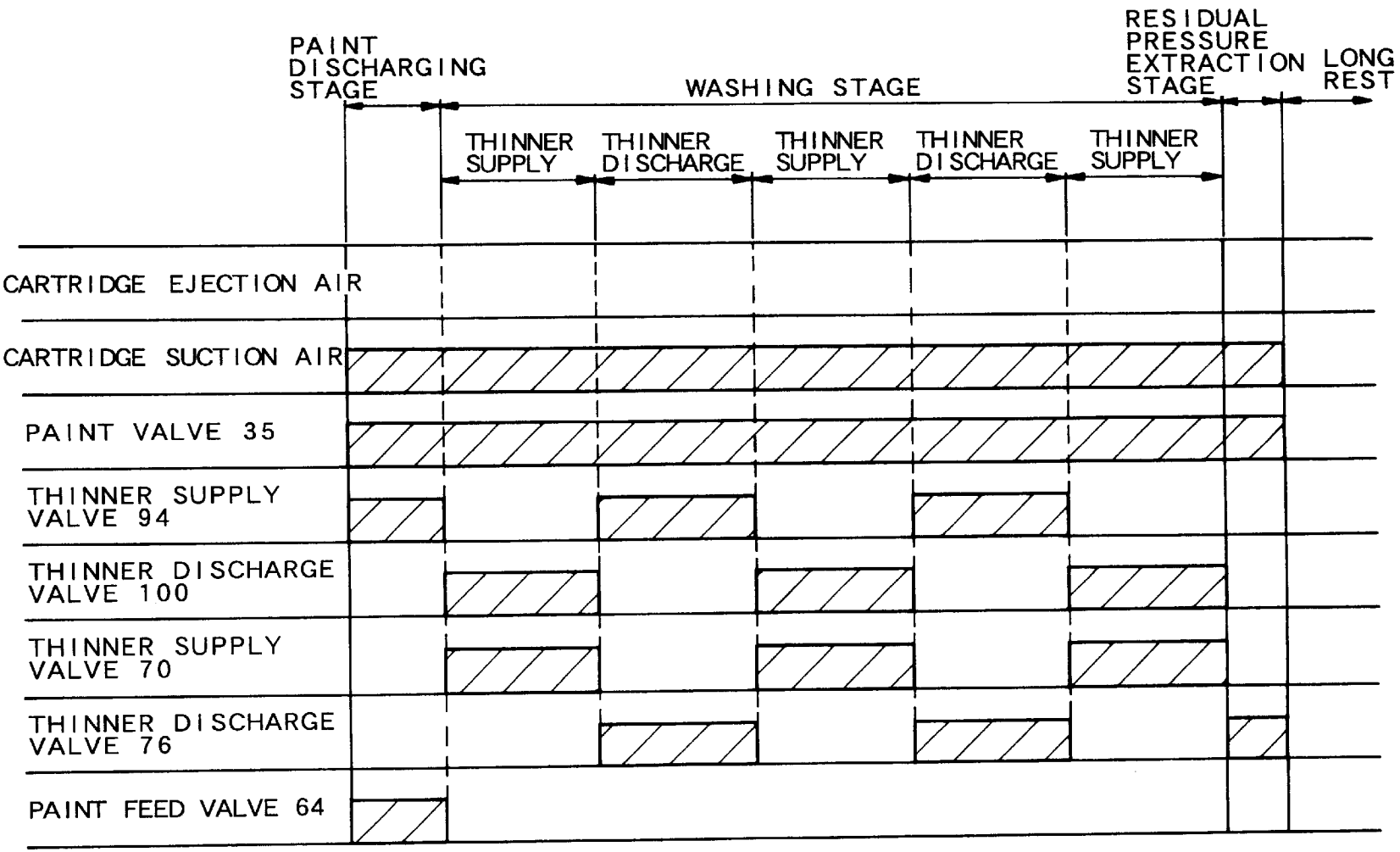
FIG. 16 is a time chart of an operation of washing with thinner the paint replenisher exclusively serving for a paint cartridge of a frequently used color.
Figure 17:
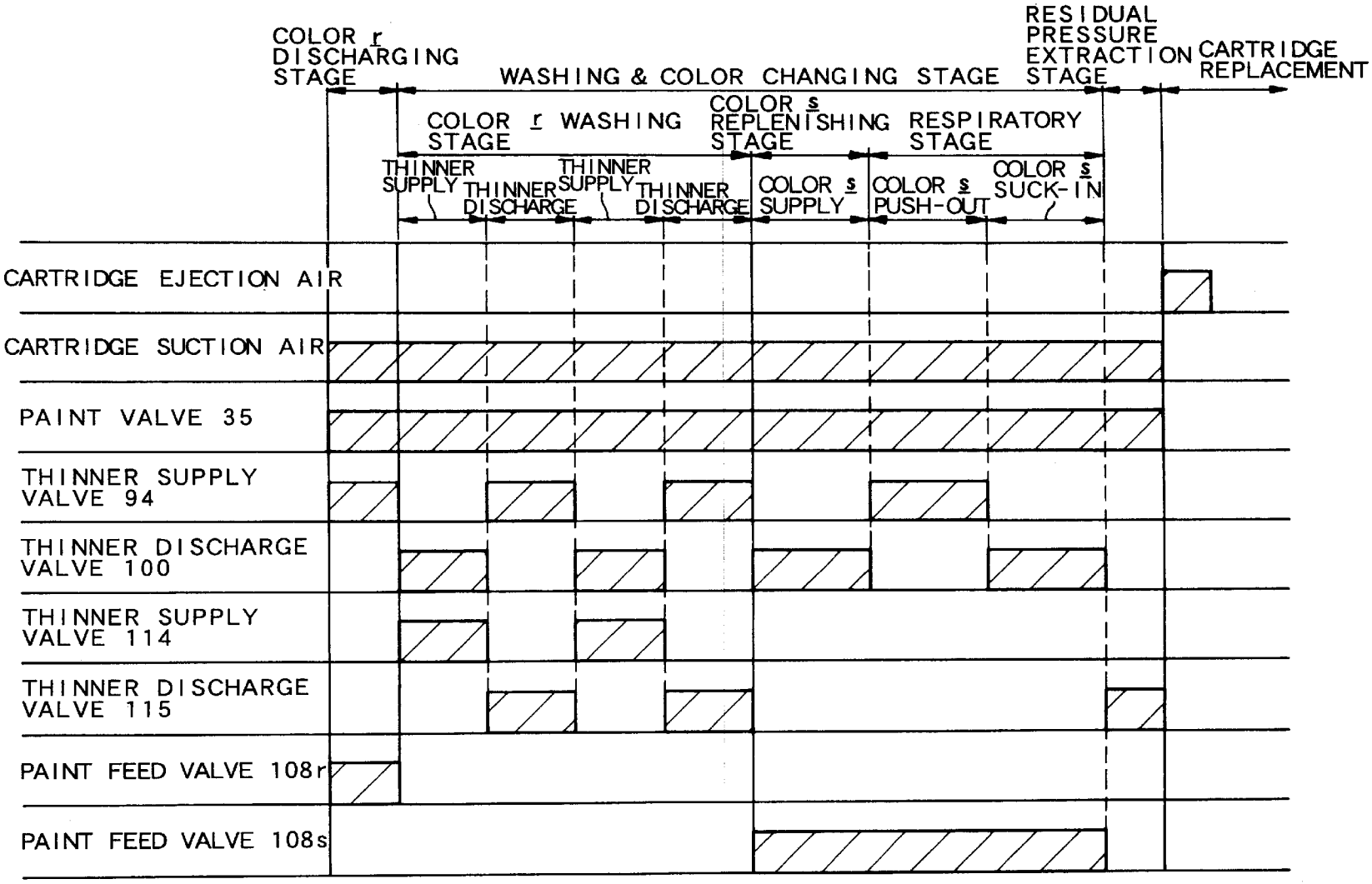
FIG. 17 is a time chart of a replenishing operation by the paint replenisher serving exclusively for a paint cartridge of a barely frequently used color.

Paint cartridge replenishing operations by the above-described paint replenishers 51 and 105 according to the present embodiment are explained in greater detail below with reference to the sectional views of FIGS. 8 through 12 and to time charts of FIGS. 15 to 17.

Firstly, prior to a paint replenishing stage, a paint cartridge 25 which has finished a coating operation is transferred to and set on the paint replenisher 51, for example, by the use of a cartridge handler which is operated in the manner as follows.

Upon completing a coating operation, a paint cartridge 25 which is loaded in the cartridge mount portion 16 of the housing 12 is unloaded therefrom by the use of a cartridge handle (not shown). For example, upon finishing a coating operation in color a, a paint cartridge 25*a* is removed from the cartridge mount portion 16 of the housing 12 and set on a replenishing stool 52*a* of a paint replenisher 51*a*.

When the paint cartridge 25 is set on the replenishing stool 52 in this manner, the container 26 is fitted in the container support portion 57 while the feed tube 28 is passed into the feed tube passage hole 56 on the side of the replenishing stool.

In addition, upon setting the paint cartridge 25 on the container support portion 57, air is sucked out through the air suction passage 83 from the vacuum space 86 which is defined on the inner side of the container 26 to hold the paint cartridge 25 fixedly on the replenishing stool 52 by suction force.

Further, upon setting the container 26 of the cartridge 25 on the container support portion 57 of the replenishing stool 52, the male and female coupling portions 26A and 26B on the container 26 are brought into engagement with the female and male coupling portion 57B and 57C on the side of the container support portion 57 to orient the container 26 into position in the radial direction relative to the container support portion 57. Besides, at this time, the conical projection 27 on the container 26 is brought into fitting engagement with the conical converging portion 56A of the feed tube passage hole 56 on the side of the replenishing stool 52 to orient the container 26 into position in both axial and radial directions relative to the container support portion 57.

Further, the fore end of the feed tube 28, which is passed into the feed tube passage hole 56 on the side of the replenishing stool, is fitted into the paint passage 59A of the connector member 59. At this time, the conical tapered surface 28C which is formed around the fore end of the feed tube 28 is fitted in the conically converging surface portion 59C of the connector member 59 to locate the opening at the fore end of the feed tube 28 at a center position within the paint passage 59A of the connector member 59.

Besides, when the fore end of the feed tube 28 is fitted into the connector member 59, the connector member 59 is movable in an upward or in a downward direction as the fore end of the feed tube 28 is fitted thereinto, thereby depending upon the vertical position of the feed tube 28. Therefore, a vertical positional deviation of the feed tube 28, if any, can be absorbed by a vertical movement of the connector member 59. Further, the feed tube 28 can be fitted in the connector member 59 in a liquid-tight state by the action of the coil spring 60 which constantly urges the connector member 59 toward the feed tube 28.

By the use of the cartridge replenisher 51, an exclusive color which is used at a relatively high frequency is replenished into a corresponding paint cartridge in the manner as described below with reference to FIG. 15.

In the first place, before refilling paint, the remainder of the paint color a, which remained in the paint cartridge 25*a* after use in a previous coating operation, needs to be once discharged in a paint discharging stage as described below.

In the paint discharging stage, as shown in FIG. 9, pilot air supplied to the paint valve 35 from the paint valve pilot air source 82 to open the paint valve 35, and at the same time pilot air is supplied to the paint feed valve 64 from the paint feed valve pilot air source 68 to open the paint feed valve 64. Further, pilot air is supplied to the thinner supply valve 94 of the respiratory paint circulation valve 91 from the thinner supply valve pilot air source 98 to open the thinner supply valve 94.

Accordingly, the paint chamber 30 of the cartridge 25*a* is communicated with the paint circulation piping 67 through the paint hose 63, the paint outlet port 62B of the manifold 62 and the paint inlet port 64B of the paint feed valve 64. On the other hand, the thinner chamber 31 of the cartridge 25*a* is communicated with the thinner supply line 97 through the thinner feed passage 90, the thinner hose 93, the respiratory thinner port 92C and thinner supply port 92A of the manifold 92, and the thinner piping 95. In this instance, since the thinner supply pressure by the thinner supply line 97 is higher than the paint supply pressure by the paint supply line 65 (paint circulation piping 67), the paint in the paint chamber 30 is pushed out into the paint circulation piping 67 by the pressure of thinner in the thinner chamber 31 and returned to the paint tank by way of the paint return line 66.

After the paint chamber of paint cartridge 25*a* becomes empty, following the paint discharging stage is a paint replenishing stage where paint is replenished into the emptied paint cartridge 25*a* as described below.

In the paint replenishing stage, as shown in FIG. 10, thinner supply valve 94 is closed, and at the same time pilot air is supplied to the thinner discharge valve 100 from the thinner discharge valve pilot air source 103 to open the thinner discharge valve 100. As a result, the thinner feed passage 90 and the thinner hose 93 are communicated with the thinner reservoir tank 102 through the thinner discharge port 100B of the the thinner discharge valve 100 and the thinner piping 101, so that thinner in the thinner chamber 31 is put substantially under the atmospheric pressure. Accordingly, the paint supply pressure through the paint circulation piping 67 becomes higher than the internal pressure of the thinner chamber 31, so that the paint which is supplied from the paint circulation piping 67 can be sucked into the paint chamber 30.

In this connection, if there is much time before a next coating operation which requires the paint cartridge 25*a*, it is put in a waiting state in a respiratory paint circulation stage for the purpose of preventing separation and sedimentation of pigments in the paint, as described below.

More particularly, in the respiratory paint circulation stage, respiratory actions similar to the above-described paint push-out and suck-in operations are repeated. Namely, in this stage, an operation of pushing out paint in the paint chamber 30 of the cartridge 25 toward the paint circulation piping 67 and returning same to the paint tank through the paint return line 66 is repeated alternately with an operation of sucking paint into the paint chamber 30 of the cartridge 25 from the paint supply line 65 through the paint circulating piping 67. By these respiratory operations, paint is constantly inhaled or exhaled (circulated inward or outward) between the paint chamber 30 of the cartridge 25 and the paint supply line 65 or the paint return line 66 to prevent separation and sedimentation of pigments in the paint.

When it becomes necessary to use the paint cartridge 25*a* for a coating operation, the respiratory paint circulation is stopped at the end of the paint suck-in operation, followed by a residual pressure extraction stage.

In the residual pressure extraction stage, the thinner discharge valve 76 is opened to discharge paint to the side of the drain piping 77 in an amount which offsets residual pressures in the paint chamber 30, feed tube 28 and paint hose 63 to restore the atmospheric pressure there. Finally, the paint valve 35 is closed to complete the paint replenishment into the paint chamber 30 of the cartridge 25*a*.

After preparing the paint cartridge 25*a* for a coating operation in this manner, it is advanced to a cartridge replacement stage. For this purpose, ejection air to cancel the suction force and release the paint cartridge 25*a* before removing same from the replenishing stool 52.

On the other hand, in case the coating line is going to be put at rest for a long period of time, it becomes necessary to prevent solidified paint deposition in the paint cartridge 25, replenishing stool 52, paint hose 63 and manifold 62 by a washing operation as described below with reference to FIG. 16.

In the first place, residual paint in the paint cartridge 25 needs to be discharged. For this purpose, in a paint discharging stage, the paint valve 35 of the cartridge 25, the paint supply valve 64 of the replenishing valve 61 and the thinner supply valve 94 of the respiratory paint circulation valve 91 are opened as shown in FIG. 9 to push out residual paint, which remains in the paint chamber 30 after use in a previous coating operation, toward the paint circulation piping 67.

After discharging residual paint in this manner in the paint discharging stage, deposited paint residues in the cartridge 25 are then washed away in a nest washing stage.

In the washing stage, as shown in FIG. 11, the paint feed valve 64 is closed, and at the same time the thinner supply valve 70 is opened. In addition, the thinner supply valve 94 is closed, and the thinner discharge valve 100 is opened. Whereupon, thinner is sucked into the paint chamber 30 of the cartridge 25 from the thinner supply line 73 through the thinner piping 71, the thinner supply port 70B of the thinner supply valve 70, thinner supply port 62C, intercommunicating passage 62E and paint outlet port 62B of the manifold 62, paint hose 63, and the feed tube 28.

In the next place, as shown in FIG. 12, the thinner supply valve 70 is closed, and at the same time the thinner discharge valve 76 is opened. In addition, the thinner discharge valve 100 is closed, and the thinner supply valve 94 is opened. Whereupon, thinner in the paint chamber 30 is pushed out to the drain side through the paint hose 63 and the drain piping 77.

Then, the above-described thinner suck-in and push-out operations are repeated and finally the paint chamber 30 is finally filled with thinner. As a result, deposited residues of a previous color are washed away from the feed tube 28, paint chamber 30 and paint hose 63, and the paint cartridge 25 is filled with thinner and put at a long rest or sleep in the replenished state.

Further, a barely frequently used paint color can be replenished by the use of the other paint replenisher 105 in the manner as described below with reference to FIGS. 14 and 17.

In this case, firstly it is necessary to push the paint color r, for example, out of the paint cartridge 25*p*, and to wash away deposited residues of the color r from the cartridge 25*p*.

For this purpose, in a stage of discharging the paint color r, as soon as the paint cartridge 25*p* is set on the replenishing stool 52*p*, the paint valve 35 of the cartridge 25*p*, the paint feed valve 108*r* of the replenishing valve 106 and the thinner supply valve 94 of the respiratory paint circulation valve 91 are opened to push residues of the previous color r out of the paint chamber 30 of the cartridge 25*p* toward the paint circulation piping 111*r* for the color r.

Following the paint discharging stage is a washing and color changing stage for washing away deposited residues of the color r from the feed tube 28, paint chamber 30 and paint hose 63. In this stage, firstly for washing off the paint color r, the paint feed valve 108*r* is closed, and the thinner supply valve 114 is opened. In addition, the thinner supply valve 94 is closed, and the thinner discharge valve 100 is opened. As a result, thinner is sucked into the paint chamber 30 from the thinner supply line 73 through the paint hose 63 and feed tube 28.

Succeedingly, the thinner supply valve 114 is closed, and the thinner discharge valve 115 is opened. In addition, the thinner discharge valve 100 is closed, and the thinner supply valve 94 is opened. As a result, thinner within the paint chamber 30 is pushed out toward the drain side through the paint hose 63. Thereafter, thinner suck-in and push-out operations (the respiratory operations) are repeated to wash away deposited residues of the paint color r from the feed tube 28, paint chamber 30 and paint hose 63.

Nextly, in place of the paint color r, a different color s is replenished into the paint cartridge 25*p* in a paint replenishing stage as described below.

In this case, the paint feed valve 108*s* is opened. At the same time, the thinner supply valve 94 is closed, and the thinner discharge valve 100 is opened. As a result, paint of the color s is sucked into the paint chamber 30 from the paint circulation piping 111*s* through the paint hose 63.

Then, a residual pressure extraction stage follows in case the paint cartridge 25*p* is going to be used for a coating operation. In the residual pressure extraction stage, the thinner discharge valve 115 is opened to extract residual pressure from the paint chamber 30 until atmospheric pressure is restored. Thereafter, the paint valve 35 is closed to remove the paint cartridge 25*p* from the replenishing stool 52*p*.

In case there is much time before using the replenished paint cartridge 25*s* of color s in a next coating operation, the paint cartridge 25*s* is retained in a waiting state in a respiratory circulation stage, in which paint suck-in and push-out operations are alternately repeated in the manner as described hereinbefore, closing the thinner discharge valve 100 and opening the thinner supply valve 94 to push out paint in the paint chamber 30 toward the paint circulation piping 111*s*.

As clear from the foregoing detailed description, the respiratory paint circulation 91 according to the present embodiment is arranged to feed thinner to and from the thinner chamber 31 of the paint cartridge 25 as a paint-extruding liquid for pushing out paint in the paint chamber 30 toward the paint circulation piping 67 or 111 and for sucking paint into the paint chamber 30 from the paint circulation piping 67 or 111 repeatedly in the fashion of respiratory movements. Therefore, even if a paint cartridge 25 is left in a waiting state on the replenishing stool 52 until a next coating operation, paint can be repeatedly pushed out and sucked in between the paint chamber 30 and the paint circulation piping 67 or 111 on the side of the paint supply source. It follows that circulative flows are aroused constantly in the paint to have pigments in the paint in a uniformly dispersed state, thereby preventing separation and sedimentation of pigments which would otherwise be likely to occur to cause clogging to the paint supply passage 28A of the feed tube 28. Accordingly, at the time of a coating operation, paint with uniformly dispersed pigments can be supplied to a coating machine to guarantee improved coating quality.

Further, the paint replenishers 51 and 105 are each constituted by the replenishing stool 52 which is provided with the container support portion 57 on the upper side thereof, the feed tube passage hole 56 which is provided on the side of and extended axially through the replenishing stool 52, and the connector member 59 which is located in a deeper position than the feed tube passage hole 56 and adapted to engage with a fore end portion of the feed tube 28 in a liquid-tight state. The paint cartridge 25 is set on the container support portion 57 of the replenishing stool 52 while the feed tube 28 is passed into the feed tube passage hole 56 on the side of the replenishing stool 52 until its fore distal end is engaged with the connector member 59. Accordingly, the opening at the fore distal end of the feed tube 28 can be utilized as a refilling port in replenishing paint into the container 26 of the paint cartridge 25.

Thus, since it becomes unnecessary to provide a paint refilling port separately from the feed tube of the cartridge as in the case of the prior art mentioned hereinbefore, the construction of the paint cartridge 25 can be simplified to a significant degree in terms of improvements in efficiency of assembling work and reductions in manufacturing cost. Besides, the abolishment of a separate refilling port contributes to reduce the points of possible paint leaks and therefore to increase the reliability of the machine in this regard. Furthermore, it becomes possible to shorted the connecting time for paint replenishment.

In addition, the connector member 59 to be engaged with a fore distal end of the feed tube 28 is vertically movably provided within the replenishing stool 52 and constantly urged toward the feed tube 28 by the coil spring 60. Accordingly, as a fore end of the feed tube 28 is brought into fitting engagement with the connector member 59, the connector member 59 is allowed to move vertically in upward or downward direction depending upon the vertical position of the feed tube 28. Namely, a positional deviation of the feed tube 28 in the vertical direction, if any, can be absorbed by a vertical movement of the connector member 59. Further, the connector member 59 can be held in liquid-tight engagement with the feed tube 28 by the action of the coil spring 60 to prevent paint leaks during replenishing operations.

Further, the replenishing valves 61 and 106 are provided with the thinner supply valve 70 or 114 and the thinner discharge valve 76 or 115. Therefore, in case a coating line is going to be put at rest for long period of time, deposited paint in the cartridge 25 can be washed with thinner to preclude possibilities of malfunctioning as caused by solidified paint deposits in the paint cartridge 25 to degrade the reliability in performance quality.

Furthermore, the connector member 59 is provided with the conically converging surface portion 59C at its upper end for engagement with the conical projection 28C at the distal end of the feed tube 28. Accordingly, an opening at the fore distal end of the feed tube 28 can be guided along the conically converging surface 59C toward a center position of the paint passage 59A of the connector member 59, and the feed tube 28 can be engaged with the connector member 59 in a liquid-tight state.

On the other hand, the container support portion 57 of the replenishing stool 52 is provided with the female and male coupling portions 57B and 57C to be engaged with the male and female coupling portions 26A and 26B which are provided on the front side of the paint cartridge 25. By engagement of these male and female coupling portions, the container 26 can be automatically oriented into position in radial direction relative to the container support portion 57.

Further, the replenishing stool 52 is provided with the conically converging portion 56A for engagement with the conical projection 27 on the front side of the container 26 of the cartridge 25. Therefore, by engagement of these portions, the container 26 can be automatically oriented into position in axial and radial directions relative to the container support portion 57.

Further, the replenishing stool 52 is provided with the air suction passage 83 in the bottom portion 57A of the container support portion 57. Accordingly, through this air suction passage 57A, air can be sucked out of the vacuum space 86, which is formed between the container 26 and the bottom portion of the container support portion 57, to hold the paint cartridge 25 fixedly on the replenishing stool 52 by suction grip. At the time of removing the paint cartridge 25 from the replenishing stool 52, the suction force on the cartridge 25 can be canceled by supply air to the vacuum space 86 through the ejection air passage 87.

Furthermore, the pilot air passage 80 is provided on the side of the replenishing stool 52 thereby to actuate the paint valve 35. Accordingly, at the time of a paint replenishing operation, pilot air is supplied through this pilot air passage 80, whereupon the paint valve 35 within the paint cartridge 25 is opened, permitting to replenish paint through the paint supply passage 28A in the feed tube 28. Upon completing a paint replenishing operation, the pilot air supply is cut off to close the paint valve 35, thereby preventing paint leaks from the feed tube 28.

In the particular embodiment shown, a rotary atomizing head type coating system 11 is mounted on the horizontal arm 4 of a coating robot 1. However, it is to be understood that the present invention is not limited to this particular arrangement. For example, a rotary atomizing head type coating system 11 may be mounted on other coating action mechanisms such as a reciprocator or the like.

Further, in the particular embodiment shown, the piston 29 is used as a movable partition wall. However, in place of the piston 29, there may be employed, for example, a bellows tube or a flexible bag the internal side of which is communicated with the feed tube.

On the other hand, although in the particular embodiment shown the respiratory paint circulation valve 91 is connected with the thinner feed passage 90 on the side of the replenishing stool 52 through the thinner hose 93, it is also possible to mount the respiratory paint circulation valve 91 integrally on the side of the replenishing stool 52 and communicate same directly with the thinner feed passage 90.

Further, in the particular embodiment shown, the respiratory paint circulation valve 91 is constituted by a couple of valves, i.e., the thinner supply valve 94 and the thinner discharge valve 100 each in the form of a 2-port 2-position on-off valve. However, the present invention is not limited to this particular example. For instance, the respiratory paint circulation valve 91 can be constituted by a single 3-port 3-position directional control valve if desired.

Furthermore, although thinner is used as a paint-extruding liquid in the particular embodiment shown, other liquids such as water can be applied as an extruding liquid depending upon the kind of paint and the type of the high voltage application system.

Moreover, if necessary, two or more paint cartridges 25 may be provided for each color in case same color or colors are used continuously, in consideration of the efficiency of color changing operations.

INDUSTRIAL APPLICABILITY

As clear form the foregoing detailed description, according to the present invention, there is provided a paint cartridge replenishing method which includes repeating paint suck-in and push-out actions by a movable partition wall of a paint cartridge to provide respiratory paint circulation between a paint chamber of the cartridge and a paint supply source in case a replenished paint cartridge has to be retained in a waiting state until a next coating operation which is a long time away. Accordingly, in case a paint cartridge in a waiting state is a long time away to a next coating operation, the paint in the cartridge is put in respiratory circulation by repeated paint suck-in and push-out actions of a movable partition wall within the cartridge to prevent separation and sedimentation of pigments in the paint and to guarantee high quality coatings.

According to the present invention, there is also provided a paint cartridge replenisher which comprises a connector member arranged to connect a fore distal end of a feed tube to a paint supply source, and a respiratory paint circulation means adapted to feed a paint-extruding liquid to and from an extruding liquid chamber within a container of a paint cartridge to suck in and push out paint to and from a paint chamber of the cartridge, arousing respiratory paint circulation between the paint chamber and the paint supply source.

Upon finishing a coating operation, fore end portion of the feed tube of the paint cartridge is connected to the paint supply source through the connector member. In this state, upon discharging the extruding liquid from the extruding liquid chamber of the cartridge by means of the respiratory paint circulation means, paint from the paint supply source is sucked into the paint chamber of the cartridge through the connector member and the fore end of the feed tube. This means that the fore end of the feed tube can be utilized also as a paint refilling port, namely, there is no necessity for providing a refilling port separately from the feed tube as in prior art paint cartridges. As a result, the construction of the paint cartridge can be simplified to a significant degree, which will be reflected by higher efficiency of assembling work and by lower manufacturing cost. Besides, the abolishment of a separate refilling port reduces the number of points of possible paint leaks, contributing to enhance the reliability in this regard.

Further, in case a replenished paint cartridge is to be put in a waiting state over a long period of time before a next coating operation, in order to prevent separation and sedimentation of pigments, paint in the cartridge is maintained in a fluidized state by respiratory action of the respiratory paint circulation means which is arranged to repeats an action of pushing out paint in the paint chamber of the cartridge toward the paint supply source through the feed tube by supplying the extruding liquid into the extruding liquid chamber of the cartridge, alternately with an action of sucking paint into the paint chamber of the cartridge by discharging the extruding liquid from the extruding liquid chamber of the cartridge. This respiratory paint circulation contributes to improve the quality of coatings and operational reliability as well.

Further, according to the present invention, a paint cartridge replenisher is constituted by a replenishing stool having a feed tube passage hole formed axially therethrough to receive a feed tube of a paint cartridge and a container support portion formed at an upper open end thereof for seating a cartridge container thereon, a connector member provided in the replenishing stool at a deeper position than the feed tube passage hole and connectible to a fore end portion of the feed tube to communicate same with a paint passage leading to a paint supply source, a replenishing valve connected to the connector member through the paint passage to put the paint passage into and out of communication, an extruding liquid feed passage provided in the replenishing stool and connectible to the extruding liquid chamber when the cartridge container is set on the container support portion of the replenishing stool, and a respiratory paint circulation valve connected to the extruding liquid feed passage and arranged to put paint in respiratory circulation between the paint chamber of the paint cartridge and the paint supply source by alternate paint suck-in and push-out actions, sucking and pushing paint into and out of the paint chamber by feeding the extruding liquid to and from the extruding liquid chamber of the paint cartridge while the paint passage is put in communication by the replenishing valve.

Accordingly, at the time of setting a paint cartridge on the container support portion of the replenishing stool, the feed tube of the cartridge is passed into the feed tube passage hole until its fore end is fitted into the connector member. Then, in this state, the replenishing valve is opened to replenish paint into the cartridge container through the feed tube, thereby utilizing an opening at the fore end of the feed tube as a refilling port.

Consequently, the cartridge construction can be simplified significantly to realize improvements in efficiency of assembling work in addition to reductions in manufacturing cost. Besides, reliability against paint leaks can also be improved.

Furthermore, when a paint cartridge is retained in a waiting state for a long period of time before a next coating operation, paint in the paint chamber of the cartridge is constantly put in respiratory circulation between the paint chamber and a paint supply source by repeated paint suck-in and push-out actions (respiratory actions) of the respiratory paint circulation means.

What is claimed is:

1. A method for replenishing paint into a paint cartridge which is divided into a paint chamber and an extruding liquid chamber by a movable partition wall, said method comprising the step of:

putting paint in said paint chamber of said paint cartridge in respiratory circulation to and from a paint supply source by imparting repeated respiratory paint suck-in and push-out motions to said movable partition wall in case said paint cartridge is going to be retained in a waiting state for a long period of time until a next coating operation.

2. An apparatus for replenishing paint into a paint cartridge having a container and a feed tube extended axially forward from said container, said container being divided by a movable partition wall into a paint chamber in communication with said feed tube and an extruding liquid chamber to and from which an extruding liquid is charged and discharged, said apparatus comprising:

a connector member adapted to connect a fore end portion of said feed tube to a paint supply source; and a respiratory paint circulation means connected to said extruding liquid chamber of said container, and adapted to arouse respiratory paint circulation between said paint chamber and said paint supply source by feeding said extruding liquid to and from said extruding liquid chamber, putting said movable partition wall in respiratory paint suck-in and push-out motions.

3. An apparatus for replenishing paint into a paint cartridge as defined in claim 2, wherein said respiratory paint circulation means is constituted by an extruding liquid supply port connected to an extruding liquid source, an extruding liquid discharge port connected to an extruding liquid reservoir tank, a respiratory extruding liquid port connected to said extruding liquid feed passage, and a directional control valve for connecting said respiratory extruding liquid port to said extruding liquid supply port or discharge port.

4. An apparatus for replenishing paint into a paint cartridge as defined in claim 2, wherein said connector member is provided with a feed tube positioning means for guiding a fore end portion of said feed tube into position when engaged therewith.

5. An apparatus for replenishing paint into a paint cartridge having a container and a feed tube extended axially forward from said container, said container being divided by a movable partition wall into a paint chamber in communication with said feed tube and an extruding liquid chamber to and from which an extruding liquid is charged and discharged, said apparatus comprising:

a replenishing stool having a feed tube passage hole axially extended therethrough to receive said feed tube of said paint cartridge and having a container support portion formed on an upper open side thereof to support said container of said paint cartridge;

a connector member provided within said replenishing stool at a deeper position than said feed tube passage hole and adapted to connect a fore end portion of said feed tube to a paint passage leading to a paint supply source;

a replenishing valve connected to said connector member through said paint passage to turn said paint passage into and out of communication;

an extruding liquid feed passage provided in said replenishing stool and adapted to be connected to said extruding liquid chamber when said paint cartridge is set on said container support portion of said replenishing stool; and a respiratory paint circulation means connected to said extruding liquid feed passage, and adapted to arouse respiratory paint circulation between said paint chamber and said paint supply source by feeding said extruding liquid to and from said extruding liquid chamber while said paint passage is turned into communication through said replenishing valve, imparting respiratory paint suck-in and push-out motions to said movable partition wall of said paint cartridge.

6. An apparatus for replenishing paint into a paint cartridge as defined in claim 5, wherein said connector member is axially movably provided within said replenishing stool and constantly urged toward said feed tube by a spring interposed between said connector member and said replenishing stool.

7. An apparatus for replenishing paint into a paint cartridge as defined in claim 5, wherein said replenishing valve is constituted by a paint inlet port connected to said paint supply source, a paint outlet port for connecting said paint inlet port to said connector member, a wash liquid supply port for connecting said paint outlet port to a wash liquid supply source, a wash liquid discharge port for connecting said paint outlet port to a drain side, a paint feed valve for opening and closing said paint inlet port, a wash liquid supply valve for opening and closing said wash liquid supply port, and a wash liquid discharge valve for opening and closing said wash liquid discharge port.

8. An apparatus for replenishing paint into a paint cartridge as defined in claim 5, wherein said container support portion of said replenishing stool is provided with a container positioning portion adapted to guide said container of said cartridge into position by engagement with a front portion of said container.

9. An apparatus for replenishing paint into a paint cartridge as defined in claim 5, further comprising a vacuum space to be defined between said container support portion of said replenishing stool and said paint cartridge when the paint cartridge is set on the replenishing stool, an air suction passage provided in said replenishing stool and opened to said vacuum space, air in said vacuum space being sucked through said air suction passage to hold said paint cartridge fixedly on said container support portion by suction force.

10. An apparatus for replenishing paint into a paint cartridge as defined in claim 5, further comprising a pilot air passage provided in said replenishing stool to supply pilot air to a paint valve provided on a side of said paint cartridge.

11. An apparatus for replenishing paint into a paint cartridge as defined in claim 5, wherein said respiratory paint circulation means is constituted by an extruding liquid supply port connected to an extruding liquid source, an extruding liquid discharge port connected to an extruding liquid reservoir tank, a respiratory extruding liquid port connected to said extruding liquid feed passage, and a directional control valve for connecting said respiratory extruding liquid port to said extruding liquid supply port or discharge port.

12. An apparatus for replenishing paint into a paint cartridge as defined in claim 5, wherein said connector member is provided with a feed tube positioning means for guiding a fore end portion of said feed tube into position when engaged therewith.

* * * * *